US005629491A

United States Patent [19]

Usa

[11] Patent Number: 5,629,491

[45] Date of Patent: May 13, 1997

[54] TEMPO CONTROL APPARATUS

[75] Inventor: Satoshi Usa, Hamamatsu, Japan

[73] Assignee: Yamaha Corporation, Japan

[21] Appl. No.: 623,810

[22] Filed: Mar. 28, 1996

[30] Foreign Application Priority Data

Mar. 29, 1995 [JP] Japan ..... 7-096252
Mar. 29, 1995 [JP] Japan ..... 7-096253

[51] Int. Cl.[6] ..... G10H 7/00

[52] U.S. Cl. ..... 84/636; 84/612

[58] Field of Search ..... 84/612, 615, 636, 84/653, 668

[56] References Cited

U.S. PATENT DOCUMENTS 4,341,140 7/1982 Ishida .
4,542,675 9/1985 Hall, Jr. et al. .
5,220,120 6/1993 Mukaino .
5,227,574 7/1993 Mukaino .
5,300,728 4/1994 Shimada ..... 84/636
5,350,882 9/1994 Koguchi et al. ..... 84/636
5,382,750 1/1995 Masahiko et al. ..... 84/636
5,429,023 7/1995 Imaizumi ..... 84/636 X

*Primary Examiner*—William M. Shoop, Jr.
*Assistant Examiner*—Jeffrey W. Donels
*Attorney, Agent, or Firm*—Graham & James LLP

[57] ABSTRACT

A tempo control signal is generated in response to operation of an operator. A plurality of kinds of tempo control data are stored for controlling tempo of automatic performance of a musical piece as the automatic performance of the musical piece proceeds when automatic performance data is reproduced. The tempo of the automatic performance of the musical piece is controlled based on a selected one of the plurality of kinds of tempo control data and the tempo control signal generated in response to the operation of the operator.

19 Claims, 20 Drawing Sheets

TEMPO CONTROL APPARATUS

BACKGROUND OF THE INVENTION

1. Field of the Invention

This invention relates to a tempo control apparatus which is capable of controlling the tempo of performance of a musical piece on real-time basis.

2. Prior Art

Conventionally, a tempo control apparatus has been in use, which controls the tempo of automatic performance of a musical piece on real-time basis according to the tempo of a tapping motion or a baton motion carried out by a player in a manner timed to each beat.

The conventional tempo control apparatus changes the tempo of performance of a musical piece merely by changing the time interval between two adjacent beats in response to the operation of the player. Therefore, to change the tempo of performance of a musical piece, the conventional tempo control apparatus has to change the tempo of performance of the musical piece in response to a tapping motion or a like tempo control operation every beat of the musical piece, irrespective of the player's skill. Generally, as the player is more skilled, he desires to control the tempo of performance with a timing shorter than the timing of each beat, e.g. with the timing of each note. However, the conventional tempo control apparatus cannot meet the player's desire.

The tempo control apparatus could be converted to one suitable for highly skilled players such that it can change the tempo with a timing shorter than the timing of one beat. Such a tempo control apparatus, however, does not suit beginners who are not skilled enough to control the tempo with such a short timing, making it impossible for them to properly control the tempo.

A tempo control apparatus which can control the tempo on real-time basis has been proposed by Japanese Laid-Open Patent Publication (Kokai) No. 6-27957 (hereinafter referred to as "the apparatus A"), which is adapted to start performance of a musical piece at an initial tempo set in advance, and then change the tempo in a manner following up the tempo control operation by the player.

Further, another tempo control system has been proposed by Japanese Patent Publication (Kokoku) No. 4-36398 (hereinafter referred to as "the apparatus B"), which is adapted to maintain a tempo having been set by manual control operation after the manual control operation is stopped, or return the tempo to a standard tempo when a tempo recovery switch is operated to inhibit the manual control operation and resume automatic tempo control.

However, the tempo control apparatus A always starts performance of a musical piece at the same initial tempo set in advance, which makes it impossible to set the tempo as desired by the player at the start of performance of the musical piece, which can result in that the player starts performance at an unstable tempo.

According to the tempo control apparatus B which maintains the tempo set by the manual control operation and forcibly recovers the standard tempo, such changing of the tempo is merely temporarily effected. That is, when the player operates the tempo control apparatus again, the tempo is changed according to his operation. More specifically, when the tempo control apparatus is operated again, the tempo is changed according to his operation irrespective of whether he intends to manually control the tempo or not. Thus, the player's intention does not necessarily reflect on the tempo. Further, when the standard tempo is recovered or the tempo is shifted from the standard tempo or the maintained tempo to a manually-controlled tempo, the tempo can be largely changed, resulting in unnatural reproduction of a musical piece.

SUMMARY OF THE INVENTION

It is a first object of the invention to provide a tempo control apparatus which is capable of controlling the tempo of performance of a musical piece in the optimal manner according to the player's skill.

It is a second object of the invention to provide a tempo control apparatus which is capable of starting performance of a musical piece from the opening thereof at a tempo desired by the player.

It is a third object of the invention to provide a tempo control apparatus which is not only capable of maintaining the tempo of performance of a musical piece as desired by the player even if the player operates the apparatus carelessly or unintentionally, but also capable of changing the tempo so as to secure natural reproduction of a musical piece.

To attain the first object, according to a first aspect of the present invention, there is provided a tempo control apparatus comprising tempo control signal-generating means for generating a tempo control signal in response to operation of an operator, automatic performance data-storing means for storing automatic performance data, tempo control data-storing means for storing a plurality of kinds of tempo control data for controlling tempo of automatic performance of a musical piece as the automatic performance of the musical piece proceeds, when the automatic performance data is reproduced, selecting means for selecting one of the plurality of kinds of tempo control data stored in the tempo control data-storing means, and tempo control means for controlling the tempo of the automatic performance of the musical piece based on the selected one of the plurality of kinds of tempo control data and the tempo control signal generated by the tempo control signal-generating means.

Preferably, the plurality of kinds of tempo control data correspond to respective timings of the operation of the tempo control signal-generating means by the operator.

Also preferably, the plurality of kinds of tempo control data comprise tempo control data corresponding to timing of each beat of the musical piece, and tempo control data corresponding to timing of each note of the musical piece.

Preferably, the tempo control signal-generating means is movable by the operation of the operator, to detect a peak of angular velocity of a motion of the operator in a predetermined direction to thereby generate the tempo control signal.

To attain the first object, according to a second aspect of the invention, there is provided tempo control apparatus comprising tempo control signal-generating means for generating a tempo control signal in response to operation of an operator, data-storing means for storing automatic performance data and a plurality of kinds of tempo control data for controlling tempo of automatic performance of a musical piece as the automatic performance of the musical piece proceeds, when the automatic performance data is reproduced, selecting means for selecting one of the plurality of kinds of tempo control data stored in the data-storing means, detecting means for detecting the selected one of the plurality of kinds of tempo control data from the plurality of kinds of tempo control data stored in the data-storing means as the automatic performance of the musical piece proceeds, and tempo control means for controlling the tempo of the automatic performance of the musical piece based on the detected selected one of the plurality of kinds of tempo control data and the tempo control signal generated by the tempo control signal-generating means.

Preferably, the plurality of kinds of tempo control data correspond to respective timings of the operation of the tempo control signal-generating means by the operator.

For example, the plurality of kinds of tempo control data comprise tempo control data corresponding to timing of each beat of the musical piece, and tempo control data corresponding to timing of each note of the musical piece.

Preferably, the automatic performance data includes event data having the same data format as the plurality of kinds of tempo control data, the plurality of kinds of tempo control data being given at least one predetermined channel number for discriminating the plurality of kinds of tempo control data from the event data.

Preferably, the tempo control signal-generating means is movable by the operation of the operator, to detect a peak of angular velocity of a motion of the operator in a predetermined direction to thereby generate the tempo control signal.

To attain the second object, according to a third aspect of the invention, there is provided a tempo control apparatus comprising tempo control signal-generating means for generating a tempo control signal in response to operation of an operator, tempo control means for controlling tempo of automatic performance based on the tempo control signal generated by the tempo control signal-generating means, tempo-storing means for storing the tempo of automatic performance controlled by the tempo control means, and initial tempo-determining means for determining an initial tempo at which the automatic performance is to be started, based on the tempo stored in the tempo-storing means.

The tempo control means starts controlling of the tempo of automatic performance to the determined initial tempo.

To attain the third object, according to a fourth aspect of the invention, there is provided a tempo control apparatus comprising tempo control signal-generating means for generating a tempo control signal in response to operation of an operator, tempo mode changeover means for changing over a mode of control of tempo of automatic performance between a manual tempo control mode in which the tempo of the automatic performance is controlled based on the tempo control signal and an automatic tempo control mode in which the tempo of the automatic performance is automatically controlled irrespective of the tempo control signal, and tempo control means for controlling the tempo of the automatic performance in the mode of control of the tempo of automatic performance selected by the changeover by the tempo mode changeover means.

When the mode of control of the tempo of automatic performance is changed over by the tempo mode changeover means, the tempo control means controls the tempo of automatic performance by progressively changing the tempo of automatic performance from a tempo assumed before the changeover of the mode of control to a tempo to be assumed after the changeover of the mode of control.

Preferably, the automatic tempo control mode is a mode in which the tempo of the automatic performance is maintained at a tempo to which the tempo of the automatic performance has been controlled in the manual control mode before the changeover of the mode of control.

Also preferably, the automatic tempo control mode is a mode in which the tempo of the automatic performance is set to a standard tempo for performance of a musical piece of which automatic performance is being given, irrespective of a tempo assumed before the changeover of the mode of control.

Preferably, the tempo control means progressively changes the tempo of the automatic performance by an amount commensurate with a difference between the tempo assumed before the changeover of the mode of control and the tempo to be assumed after the changeover.

Alternatively, the tempo control means progressively changes the tempo of the automatic performance by a predetermined constant amount.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
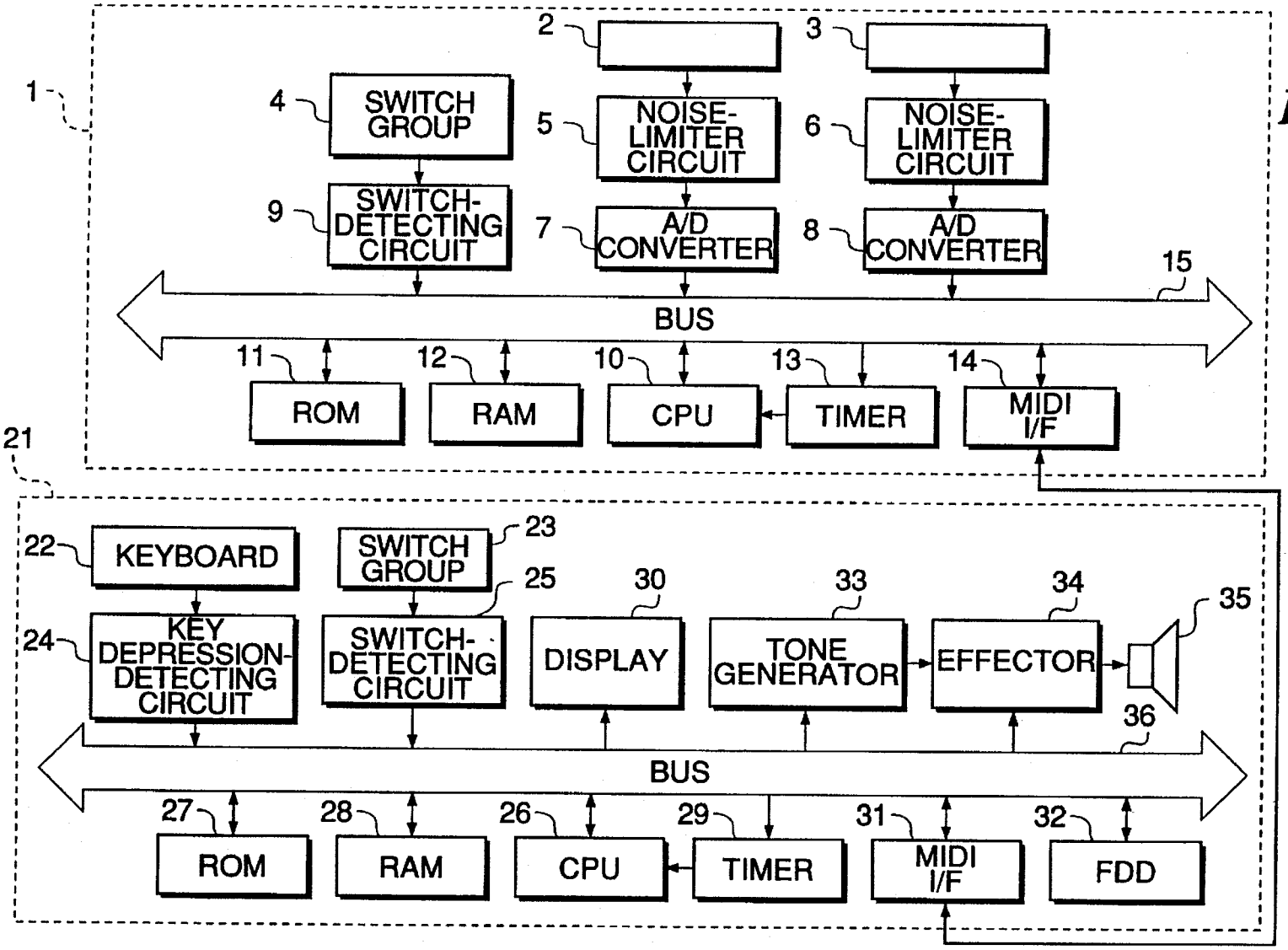
FIG. 1 is a block diagram schematically showing the whole arrangement of a tempo control apparatus according to a first embodiment of the invention.

Referring first to FIG. 1, there is shown the whole arrangement of a tempo control apparatus according to an embodiment of the invention. The tempo control apparatus is comprised of a tempo control signal-generating device 1 for generating a tempo control signal, and an electronic musical instrument 21 with a function of automatic performance, which is disposed to have the tempo of performance of a musical piece controlled by the tempo control signal from the tempo control signal-generating device 1.

In the figure, the tempo control signal-generating device 1 includes a gyroscopic piezoelectric angular velocity sensor (X) 2 which detects the angular velocity of a swing motion of the device 1 along an X-axis, i.e. in a horizontal direction caused by a swinging operation of a player about one of his elbows, and converts the sensed angular velocity into an analog electric signal, a gyroscopic piezoelectric angular velocity sensor (Y) 3 which detects the angular velocity of the swing motion of the device 1 along a Y-axis, i.e. in a vertical direction caused by the swinging operation of the player, and converts the sensed angular velocity into an analog electric signal, a switch group 4 formed by switches for inputting various kinds of information to the device 1, noise-limiter circuits 5, 6 for limiting or eliminating noise in respective signals from the gyroscopic piezoelectric angular velocity sensors 2, 3, analog-to-digital converters 7, 8 for converting the analog signals from the noise-limiter circuits 5, 6, into respective digital signals, a switch-detecting circuit 9 for detecting operative states of the switches of the switch group 4, a CPU (central processing unit) 10 for controlling the overall operation of the device 1, a ROM (read only memory) 11 storing control programs executed by the CPU 10, tables and maps for use in control operation, etc., a RAM (random access memory) 12 for temporarily storing various kinds of input information, results of calculations, etc., a timer 13 for measuring interrupt times and other various times for use in control operation, and a MIDI (musical instrument digital interface) interface (I/F) 14 via which external MIDI signals are input and internal MIDI signals are output. These component parts 7 to 14 are connected to each other via a bus 15, with the timer 13 being connected to the CPU 10.

The electronic musical instrument 21 having the automatic performance function is comprised of a keyboard 22 for generating pitch information, a switch group 23 formed by various switches for inputting various kinds of information to the instrument 21, a key depression-detecting circuit 24 for detecting depression of keys of the keyboard 22, a switch-detecting circuit 9 for detecting operative states of the switches of the switch group 23, a CPU (central processing unit) 26 for controlling the overall operation of the instrument 21, a ROM (read only memory) 27 storing control programs executed by the instrument 21, tables and maps for use in control operation, etc., a RAM (random access memory) 28 for temporarily storing various kinds of input information, results of calculations, etc., a timer 29 for measuring interrupt times and other various times for use in control operation, a display 30 formed e.g. of a LCD (liquid crystal display) for displaying automatic performance data and various kinds of information, a MIDI (musical instrument digital interface) interface (I/F) 31, via which external MIDI signals are input and internal MIDI signals are output, a floppy disk drive (FDD) 32 for driving a floppy disk (FD) as storage media, a tone generator 33 for converting performance data from the keyboard 22, automatic performance data, etc. into musical tone signals, an effector 34 for imparting various effects to the musical tone signals delivered from the tone generator 33, and a sound system 35, such as a loudspeaker, for converting the musical tone signals from the effector 34 into sound. These component parts 24 to 34 are connected to each other via a bus 36, with the timer 29 being connected to the CPU 26. The tone generator 33, the effector 34 and the sound system 35 are connected to each other and arranged in the mentioned order.

The MIDI I/F 14 of the tempo control signal-generating device 1 and the MIDI I/F 31 of the electronic musical instrument 21 are connected to each other for transfer of MIDI signals between the tempo control signal-generating device 1 and the electronic musical instrument 21. The MIDI I/F's 14, 31 may be connected to each other by wire or by radio.

The player can manually control the tempo of performance of a musical piece by swinging the tempo control signal-generating device 1 held in one hand in predetermined directions according to predetermined timing of the musical piece.

Figure 2A:
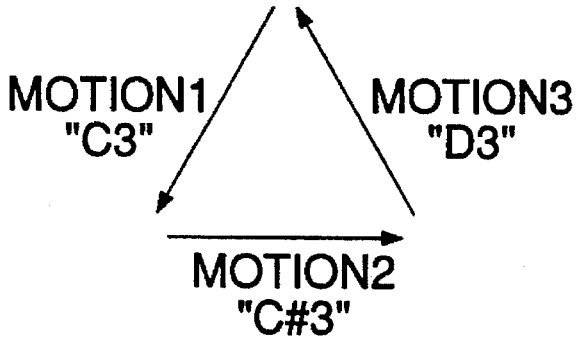
FIGS. 2A and 2B are diagrams which are useful in explaining motions of a player detected by a tempo control signal-generating device appearing in FIG. 1 and values of a tempo control signal generated in response to the detected motions of the player to be delivered therefrom.
Figure 2B:
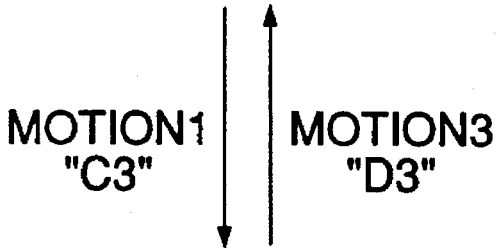

FIGS. 2A and 2B show examples of swinging operations detected by the tempo control signal-generating device 1, in which FIG. 2A shows three kinds of motions detected when the tempo control signal-generating device 1 is swung or moved by the player along the three sides of an imaginary triangle about the elbow, while FIG. 2B shows two kinds of motions detected when the device 1 is swung or moved upward and downward about the elbow in a reciprocating manner.

When the player swings or moves the tempo control signal-generating device 1, signals are delivered from the gyroscopic piezoelectric angular velocity sensors 2, 3 according to the motion, and the CPU 10 determines, based on the signals, to which of the three kinds of motions 1 to 3 shown in FIGS. 2A and 2B the player's motion corresponds, and detects a time point at which the angular velocity of the player's motion assumes a peak (which is expected to be assumed approximately at a midpoint of the stroke of each of the three kinds of motions, though it depends on a manner of moving the device 1). At the peak of the angular velocity of motion of the device 1, data (mark data) indicative of an ON event (key-on data) of a key code corresponding to the detected motion is delivered to the electronic musical instrument 21. For example, tempo key-on event data of a key code "C3", tempo key-on event data of a key code "C#3", and tempo key-on event data of a key code "D3" are delivered in response to the motions 1, 2, and 3, respectively.

Each tempo key-on event data is delivered as a MIDI signal from the MIDI I/F 14 to the MIDI I/F 31. More specifically, in the tempo control apparatus of the present invention, the tempo control signal-generating device 1 generates and delivers a tempo control signal (tempo key-on event data) as a main function, as expected from its name, and all operations of actual automatic performance processing (including reading of automatic performance data from a storage device, not shown, and sounding processing) are carried out by the electronic musical instrument 21. The tempo key-on event data thus delivered to the electronic musical instrument 21 is temporarily stored in a predetermined area of the RAM 28, and then analyzed by the CPU 26. Results of the analysis are stored in a predetermined area TKON of the RAM 28.

Figure 3:
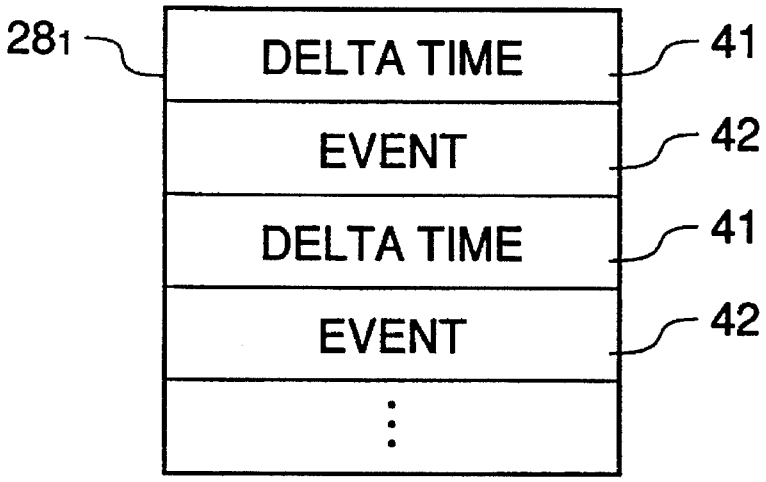
FIG. 3 is a diagram showing a format of automatic performance data used in an electronic musical instrument appearing in FIG. 1.

FIG. 3 shows a format of automatic performance data processed by the electronic musical instrument 21, which is read from the storage device and stored in an automatic performance data storage area $28_1$ of the RAM 28.

As shown in the figure, the automatic performance data is formed of delta time data 41 each indicative of a time interval between adjacent events, and event data 42 each indicative of a key-on or key-off event or the like of the electronic musical instrument 21. In the present embodiment, the delta time data 41 are each formed by an integer in terms of milliseconds with one millisecond as time unit, while the event data 42 each have a channel number allotted thereto. The delta time data 41 are formed as above because timing control of each event is executed during interrupt processing executed at time intervals of one millisecond (during execution of an automatic performance data-reproducing subroutine described hereinafter with reference to FIG. 13). The event data 42 are formed as above in order to discriminate mark data (tempo key-on data) from ordinary automatic performance data, since the electronic musical instrument 21 according to the present embodiment handles two kinds of event data, i.e. mark data-containing event data and ordinary automatic performance event data, and the mark data have a format of ordinary automatic performance event data.

Figure 4:
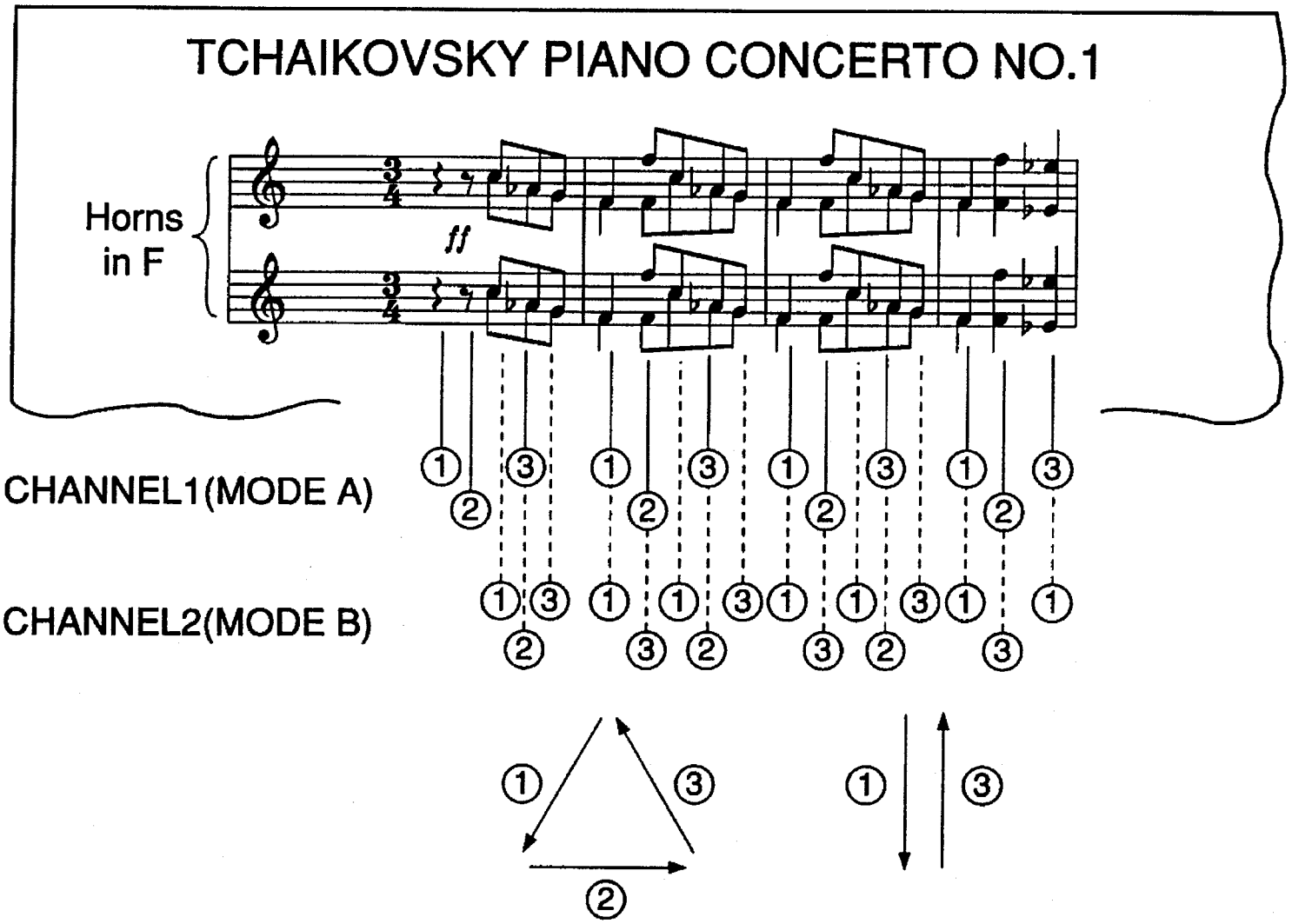
FIG. 4 is a diagram showing an example of automatic performance data for a single music piece, which contain mark data for a plurality of channels.

The mark data are classified into the aforementioned three kinds of tempo key-on event data "C3", "C#3", and "D3", and stored in respective predetermined areas (addresses) of the automatic performance data storage area $28_1$ in a predetermined order. FIG. 4 shows how the three kinds of mark data are stored in the automatic performance data storage area $28_1$ at predetermined locations in the predetermined order. The example shown in FIG. 4 corresponds to a horn part of the opening of Piano Concerto No. 1 composed by Tchaikovsky. In the figure, circled numbers 1, 2, and 3 correspond, respectively, to the motions 1 to 3 shown in FIG. 2A. That is, the mark data items "C3", "C#3", and "D3" which are given the channel number 1 are stored in the order of the motions 1, 2, and 3 at timing of each beat of each bar, while the mark data items which are given the channel number 2 are stored in the order of the motions 1 to 3 in FIG. 2A or in the order of the motions 1 and 3 in FIG. 2B at timing of each note of each bar.

Although in the illustrated embodiment, an example of a musical piece of simple triple time is given, this is not limitative, but the invention may be applied to a musical piece of simple duple time or quadruple time, for example. In such a case, the mark data items "C3" and "D3" with the channel number 1 are stored in the order of repetitions of the motions 1 and 3 shown in FIG. 2B.

Further, the electronic musical instrument 21 of the present embodiment is constructed such that automatic performance data for 16 channels (tracks) can be reproduced, and the channels 1 and 2 are used for two kinds of tempo control different in control timing. The other channels are used for reproducing ordinary automatic performance data. However, this is not limitative, but the instrument 21 may be constructed so as to carry out three or more kinds of tempo control different in control timing, and further such that the number of kinds of tempo control different in control timing can be changed depending on each musical piece.

Although in the present embodiment, the performance data is in the format of "event data+delta time data" as described hereinabove, this is not limitative, but other formats, such as a format of "event data+absolute time period data" may be employed. Further, although the delta time in milliseconds is employed in the present embodiment, delta time in length of a note may be employed (e.g. 1/24 of a quarter note).

Still further, although in the present embodiment, data for tempo control (tempo key-on event data) and data for automatic performance data are both handled by the electronic musical instrument 21, and the two kinds of data are discriminated from each other by the channel numbers, this is not limitative, but these data may be formatted in different formats. For example, tempo control data with memory addresses which correspond to locations of notes to be controlled in tempo may by employed.

Control operations executed by the CPU 10 of the tempo control signal-generating device 1 will now be described with reference to FIGS. 5 to 10. Further, control operations executed by the CPU 26 of the electronic musical instrument 21 having the automatic performance function will be described with reference to FIGS. 11 to 16.

Figure 5:
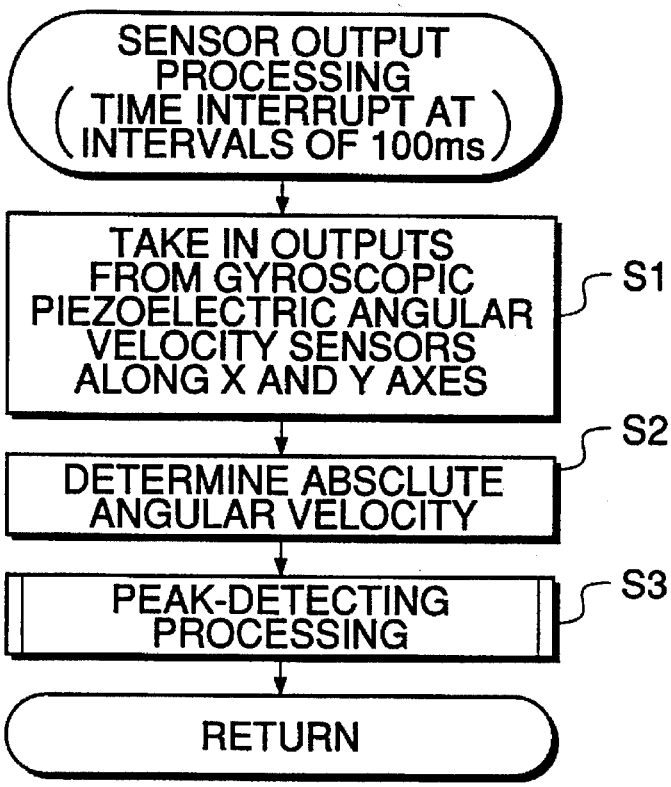
FIG. 5 is a flowchart showing a sensor output processing routine executed by a CPU of the tempo control signal-generating device in response to outputs from gyroscopic piezoelectric angular velocity sensors.

FIG. 5 shows a routine executed by the CPU 10 of the tempo control signal-generating device 1 for processing output signals from the gyroscopic piezoelectric angular velocity sensors. This routine is one of interrupt handling routines executed in synchronism with a timer interrupt signal generated e.g. every 10 milliseconds.

First, at a step S1, the output signals from the gyroscopic piezoelectric angular velocity sensor 2, 3 which have been removed of noise components by the noise-eliminating circuits 5, 6, and converted to digital data by the analog-to-digital converters 7, 8, as described hereinbefore, are stored in predetermined areas $\omega_X$, $\omega_Y$ of the RAM 12 (hereinafter, the contents of these areas will be referred to as "the angular velocity $\omega_X$" and "the angular velocity $\omega_Y$"), respectively.

Then, absolute angular velocity $\omega$ is calculated from the angular velocities $\omega X$, $\omega Y$, by the following equation (1):

$$\omega=(\omega_X^2, \omega_Y^2)^{1/2} \quad (1)$$

The calculated absolute angular velocity is stored in a predetermined area ANGV of the RAM 12 (hereinafter, the contents of the area ANGV will be referred to as "the absolute angular velocity ANGV") at a step S2.

If a value of the absolute angular velocity calculated in the immediately preceding loop remains in the predetermined area ANGV, the remaining data is moved to a predetermined area OANGV of the RAM 12 (hereinafter, the contents of the area will be referred to as "the preceding absolute angular velocity OANGV") before a value of the absolute angular velocity $\omega$ calculated in this routine is stored in the predetermined area ANGV.

Next, a peak-detecting subroutine is executed at a step S3 for detecting a time point at which the absolute angular velocity assumes a peak, followed by terminating the present program.

Figure 6:
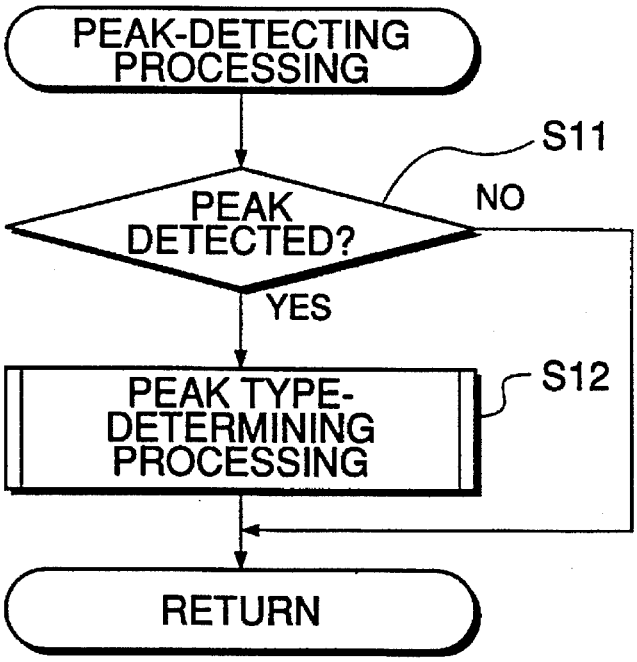
FIG. 6 is a flowchart showing a peak-detecting subroutine executed at a step S3 of the FIG. 5 routine.

FIG. 6 shows the peak-detecting subroutine. First, it is determined at a step S11 whether or not a peak has been detected. The determination of the step S11 is carried out based on the absolute angular velocity ANGV obtained in the present loop and the preceding absolute angular velocity OANGV obtained in the immediately preceding loop. More specifically, a time point at which the absolute angular velocity ANGV is larger than values obtained at earlier and later time points adjacent thereto is detected. For example, if the absolute angular velocity ANGV is larger than the preceding absolute angular velocity OANGV, a flag FBIG is set, whereas if the absolute angular velocity ANGV is equal to or smaller than the preceding absolute angular velocity OANGV, the state of the flag FBIG is checked. If the flag FGIG has been set, a time point at which the preceding absolute angular velocity OANGV was obtained is detected as a time point fulfilling the above-mentioned conditions. Then, it is determined whether or not the detected time point fulfills all conditions that a predetermined time period has elapsed after a peak was detected last time, the absolute angular velocity $\omega$ detected at this time point (i.e. the preceding absolute angular velocity OANGV) is larger than a predetermined threshold value, and larger than a value larger by a predetermined value times (e.g. 0.5 times) than the peak value detected last time, and the detected time point lies after a base. If all these conditions are fulfilled, the angular velocity at the detected time point is determined to be a peak. If any of these conditions is not fulfilled, the angular velocity at the detected time point is not determined to be a peak.

If a peak has been detected at the step S11, a peak type-determining subroutine is executed at a step S12, to determine the kind of a motion of the tempo control signal-generating device 1 (i.e. one of the motions 1 to 3 made by the player, which were described hereinabove with reference to FIGS. 2A and 2B), followed by terminating the present routine. On the other hand, if a peak has not been detected at the step S11, the present routine is immediately terminated.

Figure 7:
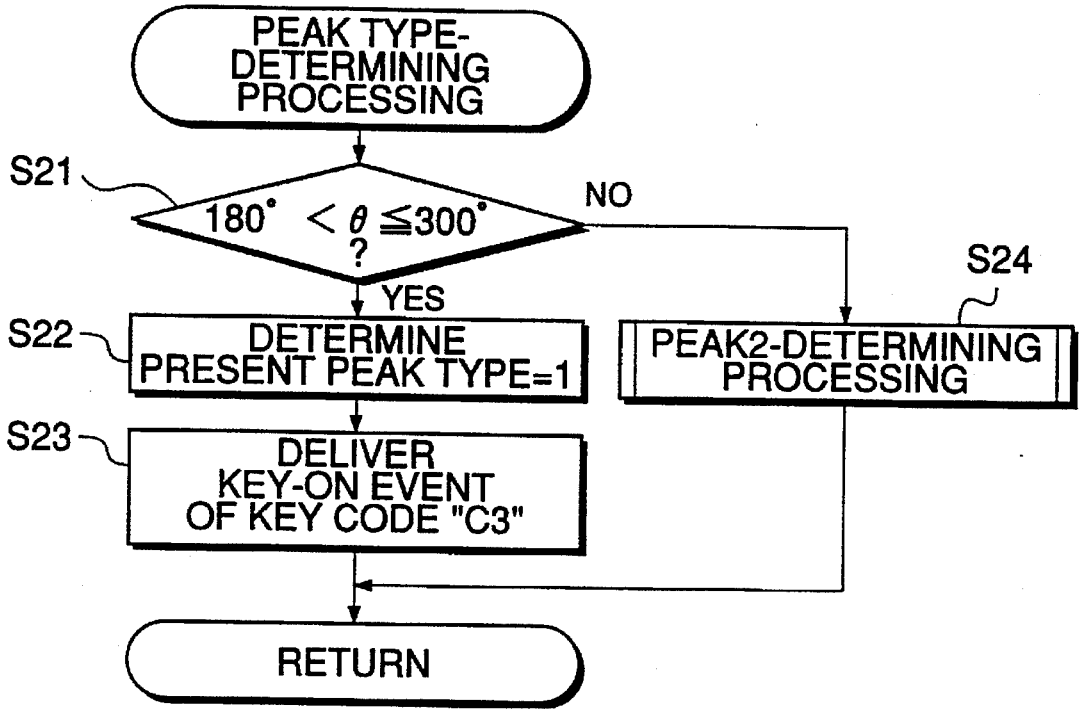
FIG. 7 is a flowchart showing a peak type-determining subroutine executed at a step S12 of the FIG. 6 subroutine.

FIG. 7 shows the peak type-determining subroutine executed at the step S12 of the FIG. 6 routine.

First, at a step S21, it is determined whether or not a swing angle $\theta$ of a motion of the tempo control signal-generating device 1 made by the player 1 fulfills a condition of $180° < \theta \leqq 300°$. A manner of calculating the swing angle $\theta$ will be described with reference to FIG. 10. In the figure, a point (X,Y) is a representation of the angular velocities $\omega X$, $\omega Y$ on a X-Y coordinate system. That is, the swing angle $\theta$ is defined as an intersection angle formed by a straight line extending through the origin O and the point (X, Y) and the X axis.

If this condition is fulfilled at the step S21, it is determined that the detected peak is ascribed to the motion 1 at a step S22, and then a MIDI signal indicative of a tempo key-on event of the key code "C3" is delivered from the tempo control signal-generating device 1, as described hereinabove, at a step S23.

On the other hand, if the swing angle $\theta$ does not fulfill the above condition, a peak 2-determining subroutine is executed at a step S24 to determine whether the detected peak is ascribed to the motion 2 or 3, followed by terminating the present program.

Figure 8:
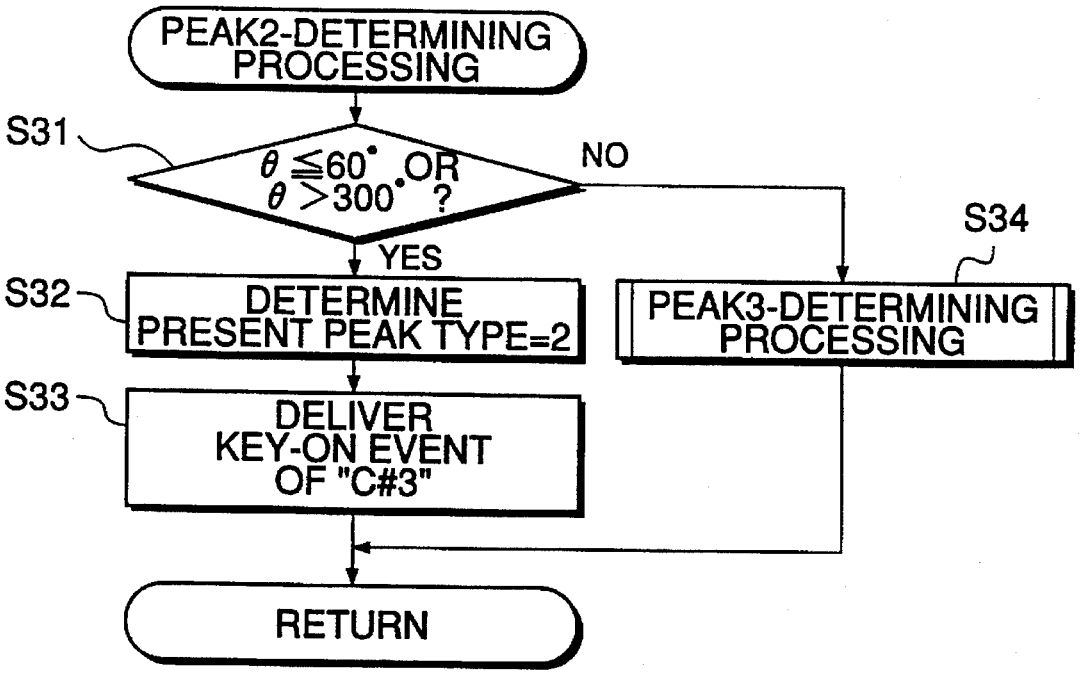
FIG. 8 is a flowchart showing a peak 2-determining subroutine executed at a step S24 of the FIG. 7 subroutine.

FIG. 8 shows the peak 2-determining subroutine.

First, it is determined at a step S31 whether or not the swing angle $\theta$ fulfills a condition of $\theta \leqq 60°$ or $300° < 0$.

If it is determined at the step S31 that the swing angle $\theta$ fulfills the above condition, it is determined, similarly to the steps 822 and S23 of the FIG. 7 routine, that the detected peak is ascribed to the motion 2, at a step $32, and then a MIDI signal indicative of a tempo key-on event at the key code "C#3", is delivered from the tempo control signal-generating device 1 at a step S33.

On the other hand, if the swing angle $\theta$ does not fulfill the above condition at the step S31, a peak 3-determining subroutine is executed at a step S34, followed by terminating the present program.

Figure 9:
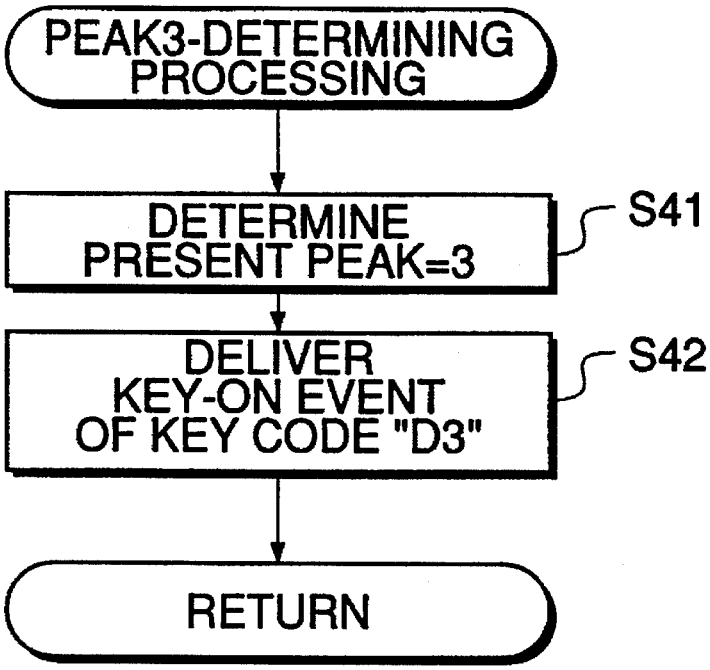
FIG. 9 is a flowchart showing a peak 3-determining executed at executing a step S34 of the FIG. 8 subroutine.
Figure 10:
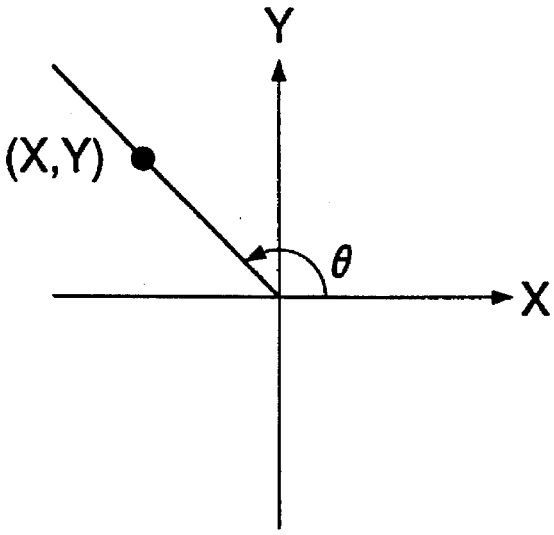
FIG. 10 is a diagram which is useful in explaining a manner of calculating an angle of swing of the tempo control signal-generating device, based on the outputs from the gyroscopic piezoelectric angular velocity sensors.

FIG. 9 shows the peak 3-determining subroutine executed at the step S34 of the FIG. 8 routine. Similarly to the steps S22 and S23 of the peak type-determining routine, it is determined at the step S41 that the detected peak is ascribed to the motion 3, and then a MIDI signal indicative of a key-on event of the key code "D3" is delivered at a step S42, followed by terminating the peak 3-determining subroutine.

Although in the present embodiment, a time point at which the absolute angular velocity $\omega$ assumes a peak is set to a time point for executing the tempo control, this is not limitative, but a time point at which the amount of change in the absolute angular velocity $\omega$ is larger than a predetermined value may be set to the time point for executing the tempo control. Further, any other method of detecting a time point for executing the tempo control may be employed.

Figure 11:
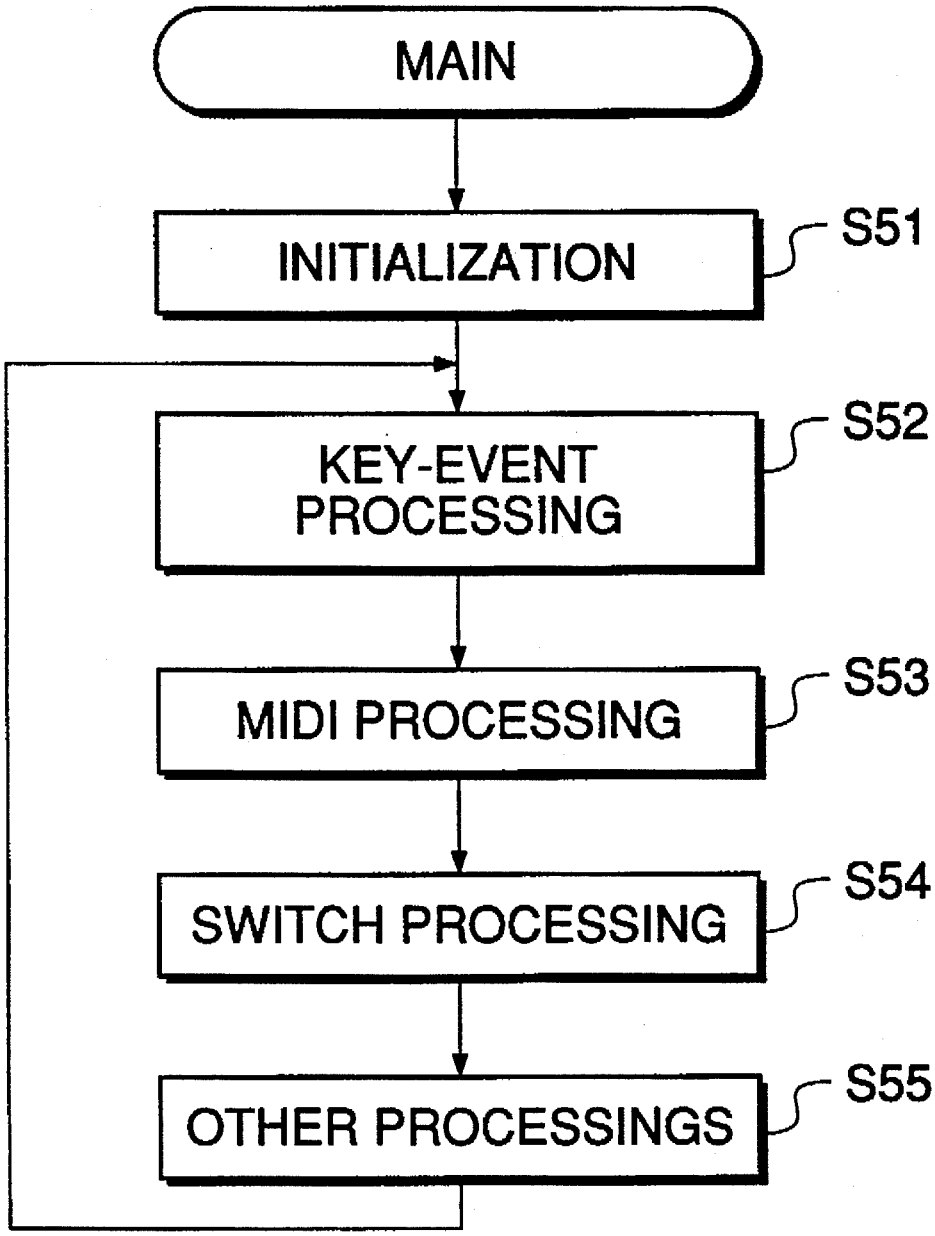
FIG. 11 is a flowchart showing a main routine executed by a CPU of the electronic musical instrument appearing in FIG. 1.

FIG. 11 shows a main routine executed by the electronic musical instrument 21. This main routine includes switch processing carried out in response to operative states of the switches of the switch group 23. The tempo control signal-generating device 1 also executes a similar main routine of its own including switch processing, description of which is omitted.

Referring to FIG. 11, first, initializations, such as clearing of the RAM 28 and various ports, are executed at a step S51.

Then, at a step S52, key-event processing is executed in response to key depression status of keys of the keyboard 22 to generate key-on event data or key-off event data, carry out sounding or stopping sounding, or carry out other key event-related operations. At a step S53, MIDI processing is executed to send or receive MIDI signals or carry out various signal processing operations based on received MIDI signals. At a step S54, the switch processing responsive to operative states of the switches of the switch group 23 is executed, as mentioned above. Then, other subroutines for processing other than the above are executed at a step S55, and then the program returns to the step S52 to repeatedly execute the above-mentioned steps S52 to S55.

Figure 12:
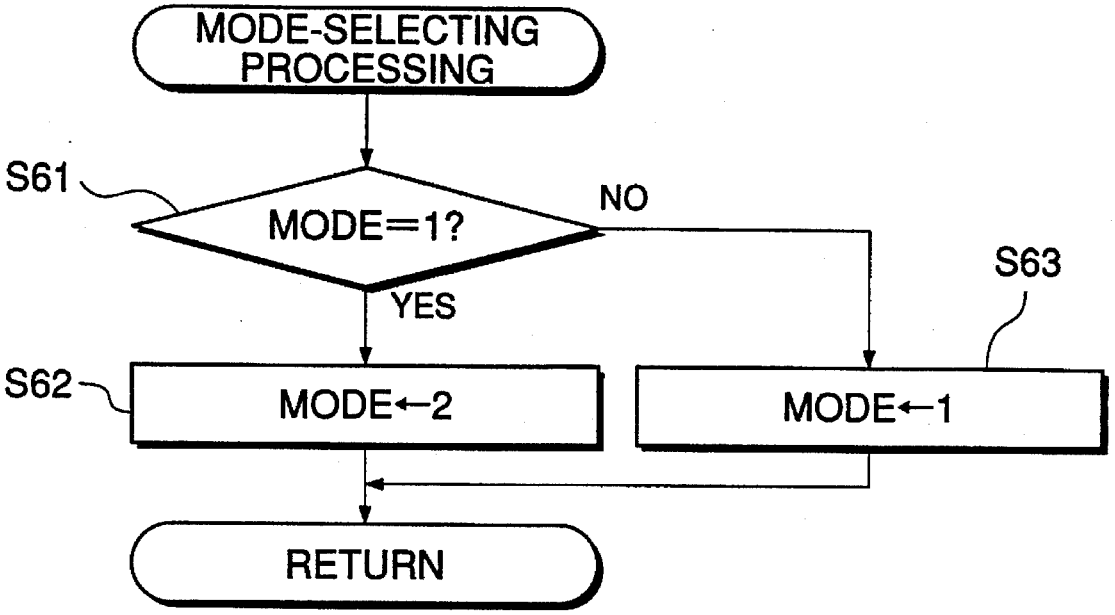
FIG. 12 is a flowchart showing a mode-selecting subroutine executed at a step S54 of the FIG. 11 main routine.

FIG. 12 shows a mode-selecting subroutine executed when a mode-selecting switch, not shown, of the switch group 23 is operated.

Referring to FIG. 12, first, it is determined at a step S61 whether or not a value stored in an area MODE (hereinafter, the contents of this area will be referred to as "the tempo control mode MODE") of the RA 28, which indicates the channel number of mark data based on which tempo control should be executed, i.e. the channel number 1 or 2, is equal to "1". If the tempo control mode MODE is "1" (hereinafter, this mode will be referred to as "MODE A"), the mark data with the channel number 1, i.e. mark data items each stored at a location corresponding to each beat timing of each bar, referred to hereinabove with reference to FIG. 4, is used for the tempo control, whereas if the tempo control mode MODE is "2" (hereinafter, this mode will be referred to as "MODE B"), the mark data with the channel number 2, i.e., mark data items each stored at a location corresponding to each note of each bar), as described hereinabove with reference to FIG. 4, are used for the tempo control.

If it is determined at the step S61 that the tempo control MODE is "1", the same is changed to "2" at a step S62, whereas if it is determined that the tempo control MODE is "2" at the step S63, the same is changed to "1", followed by terminating the program.

Although the tempo control mode is alternately set or toggled to MODE A or MODE B whenever the mode-selecting switch is operated according to the mode-selecting subroutine of the present embodiment, this is not limitative, but two switches corresponding respectively to MODE A and MODE B may be provided, whereby the tempo control mode is changed over between MODE A and MODE B by operating the respective switches.

Figure 13:
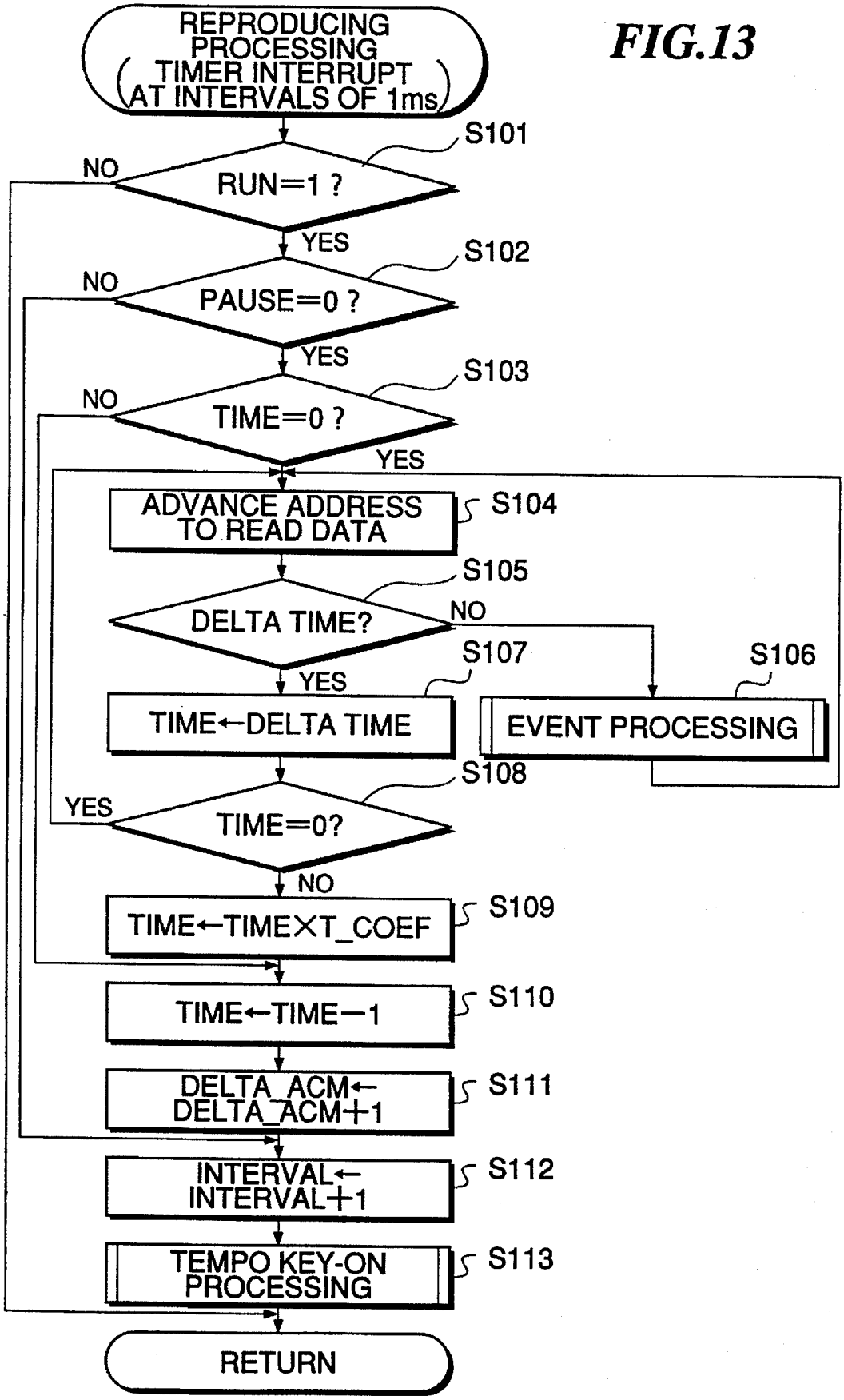
FIG. 13 is a flowchart showing an automatic performance data-reproducing routine.

FIG. 13 shows an automatic performance data-reproducing routine, which is executed e.g. as one of the interrupt handling routines executed in synchronism with an interrupt signal generated by the aforementioned timer 29 every 1 millisecond.

First, at a step S101, it is determined whether or not a data-reproducing flag RUN assumes "1". If the data-reproducing flag RUN assumes "0", i.e. if no request for reproducing automatic performance data has been made, the present program is immediately terminated, whereas if the flag RUN assumes "1", i.e. a request for reproducing automatic performance data has been made, it is determined at a step S102 whether or not a flag PAUSE assumes "0". The flag PAUSE is provided to temporarily inhibit reproduction of automatic performance data until corresponding tempo key-on event data is received from the tempo control signal-generating device 1, in the case where no corresponding tempo key-on event data has been received when the electronic musical instrument 21 reads out key-on event data for the channel 1 or 2 (tempo key-on event data).

If it is determined at the step S102 that the flag PAUSE assumes "0", i.e. if no corresponding tempo key-on event data has been received after key-on event data was received from the tempo control signal-generating device 1, it is determined at a step S103 whether or not the count of a counter TIME is equal to "0". The counter TIME is a software counter allocated to an area of the RAM 28 for counting a time interval between two adjacent event data items 42, referred to hereinabove with reference to FIG. 3.

If it is determined at the step S103 that the count of the counter TIME is equal to "0", i.e. if it is timing for delivering event data 42, the address of the automatic performance data-storing area $\mathbf{28}_1$ is advanced to read data from the next address at a step S104, and it is determined at a step S105 whether or not the data read out is delta time data.

Figure 15:
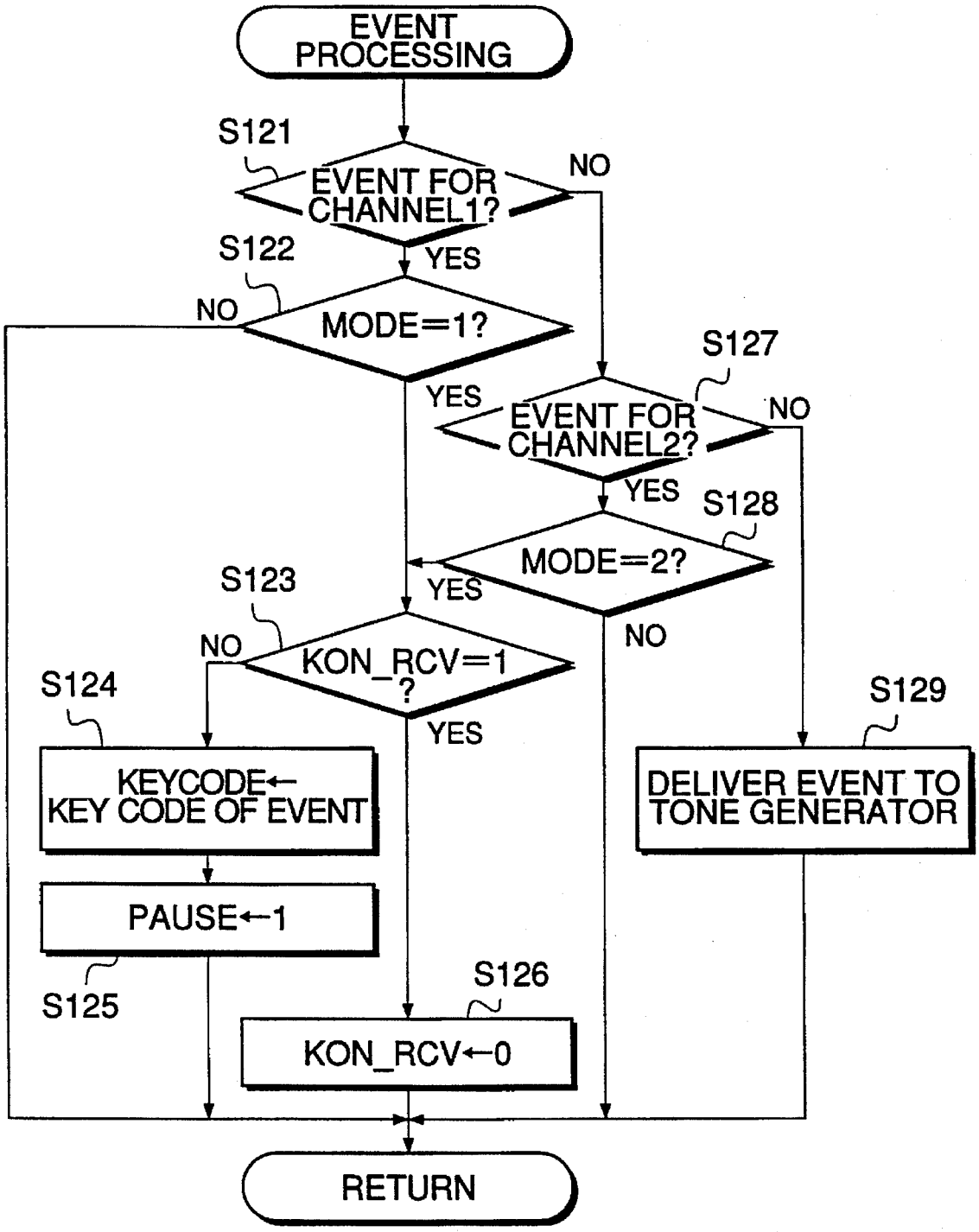
FIG. 15 is a flowchart showing an event processing subroutine executed at a step S106 of the FIG. 13 subroutine.

If it is determined at the step S105 that the data read out is not delta time data, in other words, the data read out is event data, an event-processing subroutine for processing an event corresponding to the event data read out, which will be described in detail with reference to FIG. 15, is executed at a step S106, and then the program proceeds to the step S104, followed by repeatedly executing the above steps.

On the other hand, if it is determined at the step S105 that the data read out is delta time data, the delta time data is stored in the counter TIME at a step S107, and it is determined at a step S108 whether or not the count of the counter TIME assumes "0". The count of the counter TIME is checked here because a plurality of event data items can be stored in the automatic performance data storage area $\mathbf{28}_1$ at the same timing.

If it is determined at the step S108 that the count of the counter TIME is equal to "0", the program returns to the step S104 to repeatedly execute the above steps, whereas if the count of the counter TIME is not equal to "0", the count of the counter TIME is changed at a step S109 by the use of the following equation (2):

$$\text{TIME}=\text{TIME}\times T_\text{COEF} \tag{2}$$

where T_COEF represents a tempo coefficient, followed by the program proceeding to a step S110. That is, at the step S109, the time interval of adjacent event data items indicated by the delta time data is changed by the tempo coefficient T_COEF to thereby change the tempo. Therefore, when the tempo coefficient T_COEF assumes "1", the musical piece is played at a standard tempo. When the tempo coefficient T_COEF is smaller than "1", the musical piece is played at a quicker tempo than the standard tempo, whereas when the tempo coefficient T_COEF is larger "1", the musical piece is played at a slower tempo than the standard tempo.

On the other hand, if it is determined at the step S103 that the count of the counter TIME is not equal to "0", the program jumps to the step S110.

Figure 16:
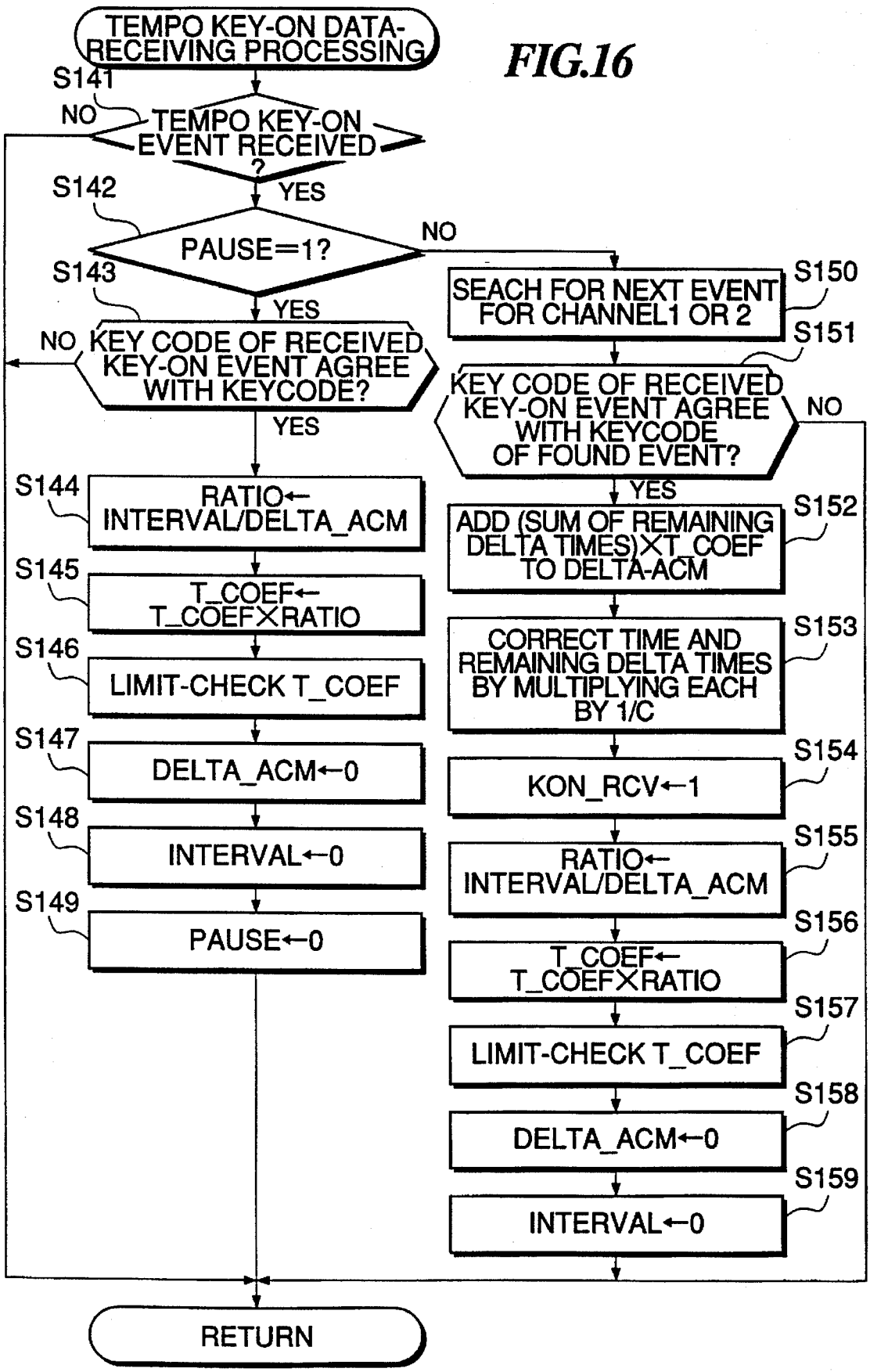
FIG. 16 is a flowchart showing a tempo key-on data-receiving subroutine executed at the FIG. 13 subroutine.

At the step S110, the count of the counter TIME is decremented by "1", and at a step S111, the count of a software counter DELTA_ACM allocated to an area of the RAM 28 for counting a time interval between adjacent key-on event data items for the channel 1 or 2 (hereinafter, the count of the software counter DELTA_ACM will be referred to as "the delta time cumulative value DELTA_ACM") is incremented by "1", and at a step S112, the count of a software counter INTERVAL allocated to an area of the RAM 28 for counting a time interval between adjacent tempo key-on event data items delivered from the tempo control signal-generating device 1 (hereinafter the count of this software counter INTERVAL will be referred to as "the tempo control interval INTERVAL") is incremented by "1". Then, at a step S113, a tempo key-on data-receiving subroutine, described hereinafter with reference to FIG. 16, is executed, followed by terminating the program.

On the other hand, if it is determined at the step S102 that the flag PAUSE assumes "1", i.e. if key-on event data for the channel 1 or 2 has been read out from the automatic performance data storage area $\mathbf{28}_1$, and delivery of the corresponding tempo key-on event data from the tempo control signal-generating circuit is being awaited, the automatic performance data-reading processing of the steps S103 to S111 referred to above is stopped (the steps are skipped over), and then the program proceeds to the step S112.

Figure 14:
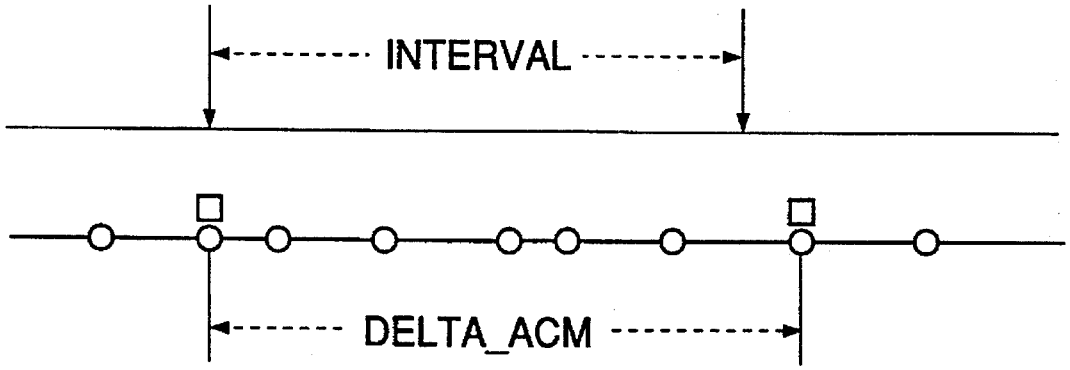
FIG. 14 is a diagram which is useful in explaining the relationship between a tempo control interval INTERVAL and a delta time cumulative value DELTA_ACM.

FIG. 14 shows the relationship between the tempo control interval INTERVAL and the delta time cumulative value DELTA_ACM, and in the figure, symbol "□" represents a key-on event for the channel 1 or 2, whereas symbol "○" represents an event other than key-on events for the channels 1 and 2.

As shown in the figure, the delta time cumulative value DELTA_ACM is a cumulative value of delta times stored for one beat or for one note in the automatic performance data storage area $28_1$, and the tempo control interval INTERVAL is a measured value of a time period for one beat or for one note, which is set by the player by swinging the tempo control signal-generating device 1 for tempo control. As will be described hereinafter, the tempo coefficient T_COEF is calculated based on the delta time cumulative value DELTA_ACM and the tempo control interval INTERVAL. FIG. 14 shows a case where the tempo control interval INTERVAL is smaller than the delta time cumulative value DELTA_ACM, i.e. when the player swings the tempo control signal-generating device 1 so as to control the tempo to a quicker tempo than the standard tempo.

FIG. 15 shows the event-processing subroutine for executing the step S106 of the FIG. 13 routine.

First, it is determined at a step S121 whether or not the event data read out is key-on event data for the channel 1 (tempo key-on event data). If the read data is tempo key-on event data, it is determined at a step S122 whether not the current tempo control mode MODE is "1", i.e. MODE A.

If it is determined at the step S122 that the present tempo control mode is MODE A (tempo control mode MODE=1), the program proceeds to a step S123, whereas if it is determined at the step S122 that the present tempo control mode is MODE B, the key-on event data for the channel 1 is ignored, followed by immediately terminating the present program.

At the step S123, it is determined whether or not a flag KON_RCV which, when set to "1", indicates that corresponding tempo key-on event data for the channel 1 or 2 has been received from the tempo control signal-generating device 1 before key-on event data for the channel 1 or 2 is read out, assumes "1". If the flag KON_RCV assumes "0", i.e. if the corresponding tempo key-on event data has not been received from the tempo control signal-generating device 1, the key code of the key-on event data is stored in an area KEYCODE allocated to the RAM 28 (hereinafter the contents of this area will be referred to as "the key code KEYCODE") at a step S124, and the flag PAUSE is set at a step S125, followed by terminating the program.

If the flag KON_RCV assumes "1", the flag KON_RCV is reset at a step S126, followed by terminating the program.

On the other hand, if it is determined at the step S121 that the event data read out is not for the channel 1, it is determined at a step S127 whether or not the event data read out is for the channel 2.

If it is determined at the step S127 that the event data read out is for the channel 2, the program proceeds to a step S128, wherein it is determined whether or not the current tempo control mode MODE is "2", i.e. MODE B. If the current tempo control mode is MODE B, the program proceeds to the step S123 et seq. to repeatedly execute the operations described above, whereas if the current tempo control mode is not MODE B, the event for the channel 2 is ignored, and the program is immediately terminated.

On the other hand, if it is determined at the step S127 that the event data read out is for a channel other than the channel 2, that is, the event data is ordinary automatic performance data, and then the event data is delivered to the tone generator 33 at a step S129, followed by terminating the program.

FIG. 16 shows the tempo key-on data-receiving subroutine executed at the step S113 of the FIG. 13 routine.

First, it is determined at a step S141 whether or not tempo key-on event data has been received from the tempo control signal-generating device 1. If the tempo key-on event data has been received, it is determined at a step S142 whether or not the flag PAUSE assumes "1". If the flag PAUSE assumes "1" at the step S142, it is determined at a step S143 whether or not the key code of the tempo key-on event data received agrees with the aforementioned key code KEYCODE. If the former agrees with the latter, the program proceeds to a step S144.

The determination of the tempo key-on event at the step S141 may be carried out by checking the contents of the area TKON.

On the other hand, if it is determined at the step S141 that the tempo key-on event data has not been received, or if it is determined at the step S143 that the key code of the tempo key-on event data received does not agree with the key code KEYCODE, the present program is immediately terminated.

At the step S144, a ratio RATIO for changing the tempo coefficient T_COEF is calculated based on the delta time cumulative value DELTA_ACM and the tempo control interval INTERVAL, by the use of the following equation (3):

$$\text{RATIO}=\text{INTERVAL}/\text{DELTA_ACM} \quad (3)$$

The ratio RATIO thus calculated is stored in a predetermined area RATIO allocated to the RAM 28 (hereinafter, the contents of this area will be referred to as "the ratio RATIO").

Next, the tempo coefficient T_COEF is changed at a step S145 by the use of the following equation (4):

ti T_COEF=T_COEF×RATIO+tm (4)

Then, limit-checking of the changed T_COEF value is carried out at a step S146 so as to prevent the changed T_COEF value from being largely changed. Then, the delta time cumulative value DELTA_ACM, the tempo control interval INTERVAL, and the flag PAUSE are reset at respective steps S147 to S149, followed by terminating the program.

On the other hand, if the flag PAUSE assumes "0" at the step S142, the next key-on event data for the channel 1 (during MODE=1) or 2 (during MODE=2) is searched from the automatic performance data storage area 281 at a step S150, and it is determined at a step S151 whether or not the key code of the received tempo key-on event data and the key code of the key-on event data found by the search agree with each other. If they agree with each other, the program proceeds to a step S152, whereas if they do not agree with each other, it means occurrence of an error, so that the present program is immediately terminated.

At the step S152, the delta time cumulative value DLTA_ACM is calculated by the use of the following equation (5):

$$\text{DELTA_ACM}=\text{DLTA_ACM}+(\text{TIME}+\Sigma\text{DELTAT}(k))\times\text{T_COEF} \quad (5)$$

where DELTA_ACM on the right side represents the present count of the soft counter updated at the step S111 of the FIG. 13 routine, TIME represents the count of the counter TIME, and ΣDELTAT(k), (k=1, 2, . . . ) represents the sum of delta times obtained by adding together delta times from a delta time belonging to event data next to the present event data which is being reproduced to a delta time belonging to on event data immediately preceding the key-on event data just searched.

Figure 17:
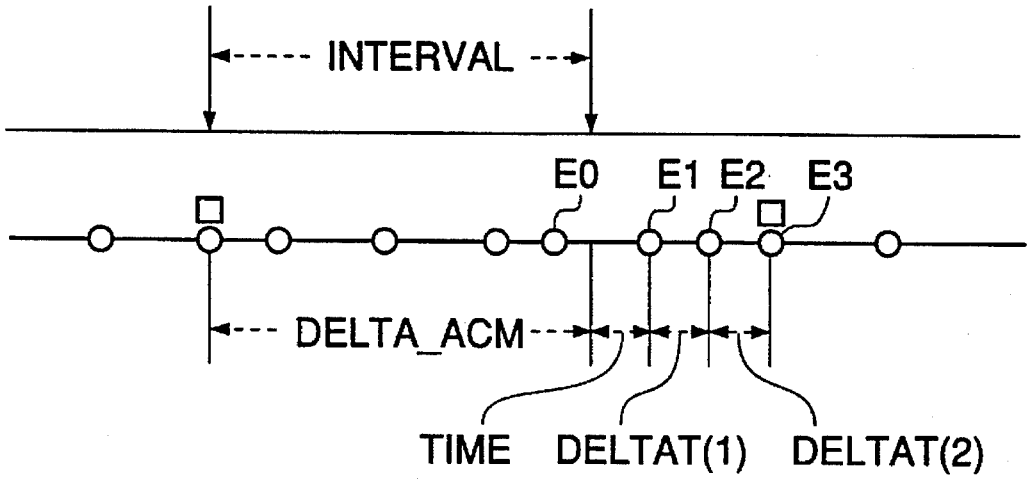
FIG. 17 is a diagram which is useful in explaining a manner of calculating the delta time cumulative value DELTA_ACM.

FIG. 17 shows a manner of calculating the delta time cumulative value DELTA_ACM.

The illustrated example shows a case where before key-on event data for the channel 1 or 2 is read from the automatic performance data storage area 281, tempo key-on event data is received from the tempo control signal-generating device 1, and at least one event data item for a channel or channels other than the channels 1 and 2 is stored in the automatic performance data storage area $28_1$ between a location corresponding to the time point of reception of the tempo key-on event and a location where a key-on event data item for the channel 1 or 2 corresponding to the received tempo key-on event is stored. In the figure, TIME represents the count of the counter TIME, i.e. a remaining portion of a delta time between event data items E0 and E1, DELTAT(1) a delta time between the event data item E1 and an event data item E2, and DELTAT(2) a delta time between the event data item E2 and an event data item E3. That is, in the illustrated example, the symbol Σ of the above equation (5) represents addition of values of DELTAT(k) with k=1, and 2.

Thus, the delta cumulative value DELTA_ACM between adjacent key-on event data items for the channel 1 or 2 can be determined by the use of the equation (5).

Referring again to FIG. 16, at a step S153, delta times from a delta time belonging to event data next to the present event data which is being reproduced to a data time belonging to a delta time immediately preceding the searched key-on event and the count of the counter TIME are each divided by a predetermined value C, to thereby change the delta times and the count of the counter TIMF. More specifically, in the example illustrated in FIG. 17, these values are changed by the use of the following equations (6) to (8):

$$TIME=TIME/C \quad (6)$$

$$DELTAT(1)=DELTAT(1)/C \quad (7)$$

$$DELTAT(2)=DELTAT(2)/C \quad (8)$$

where C represents the predetermined value which is a constant larger than "1". By thus changing the delta times and the count of the counter TIME, it is made possible to quickly start reading event data between the next pair of adjacent mark data items.

Referring again to FIG. 16, at a step S154, the flag KON_RCV is set, and the steps S155 to S159, which are identical with the steps S144 to S148, respectively, are executed, followed by terminating the tempo key-on data-receiving routine.

As described above, according to the present embodiment, two kinds of mode, i.e. MODE A and MODE B, are provided as the tempo control mode, wherein MODE A is for effecting tempo control at timing of each beat, which is suitable for a beginner, and MODE B is for effecting tempo control at timing of each note, which is suitable for a skilled player. This makes it possible for a player to carry out the optimum tempo control by operating the tempo control signal-generating device 1 according to the skill of the player.

Further, since mark data and ordinary automatic performance data are both handled by the electronic musical instrument 1, it is possible to save or reduce the capacity of the RAM 28, which contributes to reduction of the manufacturing cost.

Although in the present embodiment, the two kinds of the tempo control mode, MODE A and MODE B, are used, this is not limitative, as mentioned hereinabove, and the control timing is not necessarily limited to the timing of each beat and the timing of each note, which are employed in the present embodiment, only by way of example.

Further, although in the present embodiment, the choice of the tempo control mode is made by the player himself, this is not limitative, but the degree of skill of the player may be detected, and one of different tempo control modes may be automatically selected according to the detected degree of skill, to thereby automatically allow the control mode of a higher level, which requires a higher skill, to be selected by a player having such a higher level of skill. The determination of the degree of skill of the player may be carried out by means of a known performance agreement-determining method.

Next, a second embodiment of the invention will be described. The second embodiment is adapted to attain the second and third objects of the invention and distinguished from the first embodiment described above in the following points: An initial value of the tempo coefficient T_COEF, which sets the tempo of performance of a musical piece at the start of reproduction of automatic performance data thereof, can be selectively set to a value applied through manual tempo control on the last occasion or a value for a standard tempo. Further, when the tempo control mode is shifted from a manual tempo mode in which the tempo is manually controlled by the player to an auto tempo mode in which the tempo is automatically controlled, the tempo control apparatus according to the second embodiment is capable of selecting between a mode for maintaining a tempo used in the manual control mode and a mode for recovering a standard tempo of performance of a musical piece. In the present embodiment, only one manual tempo control mode is provided (MODE B of the first embodiment is not provided), and accordingly key-on event data for the channel 2 is not used for tempo control.

The basic hardware construction of the present embodiment is identical with that of the first embodiment. Therefore, component elements and parts corresponding to those used in the first embodiment are designated by identical reference numerals, and description thereof is omitted, except those which are different from the first embodiment.

The switch group 4 of the tempo control signal-generating device 1 according to the second embodiment includes a start switch, a start mode switch, an auto-1 switch, an auto-2 switch and a manual switch, none of which are shown.

The start switch is for starting the automatic performance of the electronic musical instrument 21. The start mode switch is for selectively setting an initial tempo of performance to a tempo used in the immediately preceding performance or a standard tempo, as will be described hereinafter.

The electronic musical instrument 21 having the automatic performance function can be selectively set to the manual tempo mode for reproducing data of a musical piece at a tempo determined or set by manual tempo control via the tempo control signal-generating device 1 or the auto tempo mode for reproducing data of the musical piece at a tempo determined or set by the automatic performance function itself. The auto tempo mode is classified into an auto-1 mode for maintaining a tempo to which the tempo of performance of a musical piece has been controlled before the tempo control mode is changed from the manual tempo mode to the auto tempo mode, and an auto-2 mode for resetting the tempo to a standard tempo of performance of the musical piece.

The auto-1 switch is for selecting the auto-1 mode, the auto-2 switch for selecting the auto-2 mode, and the manual switch for selecting the manual tempo mode.

In the present embodiment, key-on event data (mark data) of key codes corresponding to detected motions of the tempo control signal-generating device 1 are all imparted with the channel number of the channel 1, and delivered to the electronic musical instrument 21 as tempo key-on event data.

Events or settings for control of the electronic musical instrument 21 made by the start switch, the auto-1 switch, etc. are converted into MIDI signals, and supplied via the MIDI I/F's 14, 31 to the electronic musical instrument 21.

In the present embodiment, key-on event data for the channel 1 as shown in FIG. 4 are read out and stored in a predetermined area (addresses) of the automatic performance data storage area $28_1$ in the predetermined order.

On the other hand, the tempo control signal-generating device 1 generates tempo key-on event data having the channel number of the channel 1. The control operation by the CPU of the device 1 is carried out in the same manner as described with respect to the first embodiment, and description thereof is omitted. Further, the control operation by the CPU 26 of the electronic musical instrument 21 is carried out according to the FIG. 11 main routine executed by the first embodiment, and description thereof is also omitted.

Figure 18:
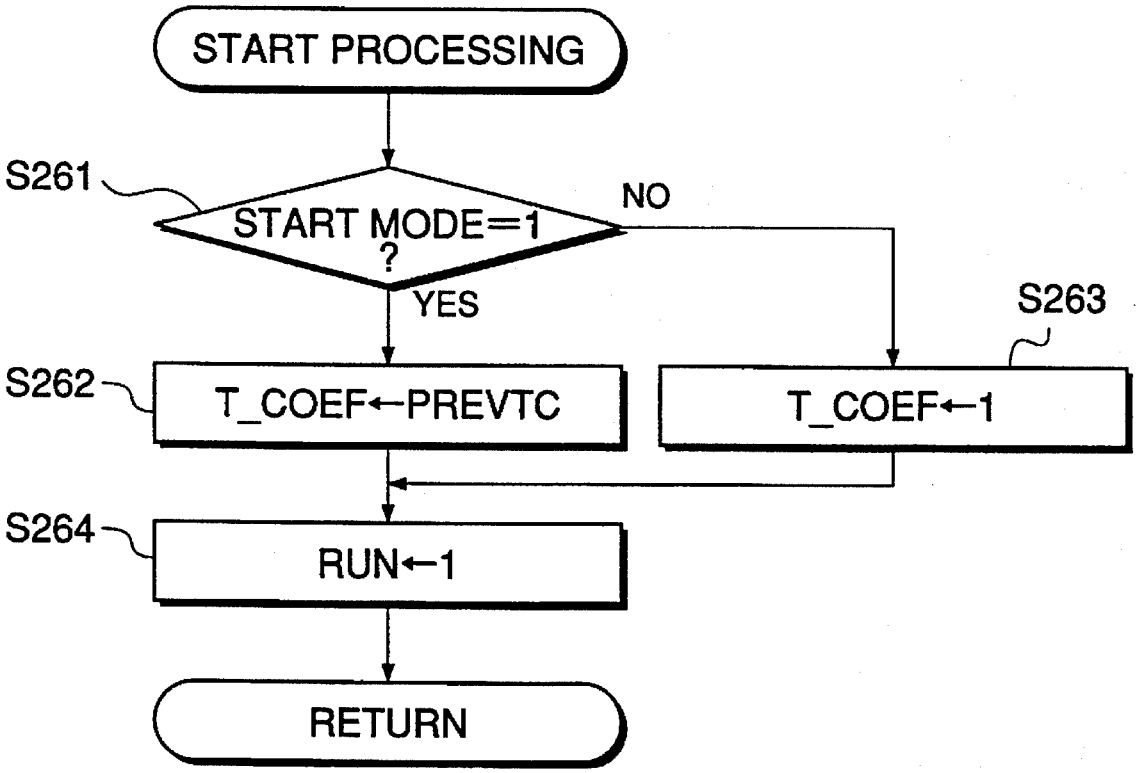
FIG. 18 is a flowchart showing a start processing routine executed by a CPU of an electronic musical instrument of a tempo control apparatus according to a second embodiment of the invention when a start switch of a switch group of a tempo control signal-generating device of the tempo control apparatus is operated.

FIG. 18 shows a start routine executed by the CPU 26 of the electronic musical instrument 21 when the start switch of the switch group 4 is operated. When the player operates the start switch, a MIDI signal corresponding to the switch-on event is delivered from the MIDI I/F 14 and received via the MIDI I/F 31 to be stored in a predetermined area of the RAM 28 of the electronic musical instrument 21. The MIDI signal is analyzed at the step S53 of the FIG. 11 main routine and stored in the area TKON to call the start routine into execution. That is, the start routine is one of subroutines for the MIDI processing executed at the step S53 of the FIG. 11 main routine.

Referring to FIG. 18, first, it is determined at a step S261 whether or not the present start mode is start mode 1. The start mode is an operating mode of the electronic musical instrument 21 in which the initial tempo of performance of a musical piece can be selectively set to a tempo to which the tempo of performance of the musical piece was controlled on the last occasion (start mode 1) or to a standard tempo of the musical piece (start mode 2). The start mode 1 and the start mode 2 are selected by the start mode switch of the switch group.

If it is determined at the step S261 that the start mode 1 has been selected, i.e. when the tempo used in the last performance is adopted as the initial tempo for starting performance of the musical piece, the contents of a predetermined area PREVTC of the RAM 28 for storing control data (tempo coefficient) of the tempo used in the last performance are stored in a predetermined area or register T_COEF (hereinafter, the contents of this area or register will be referred to as "the tempo coefficient T_COEF") at a step S262, whereas if it is determined that the start mode 2 has been selected, i.e. when the standard tempo of the musical piece is adopted as the initial tempo, a value of "1" is stored in the area T_COEF at a step S263.

At the following step S264, a flag RUN for requesting reproduction of performance data of a musical piece is set to "1", followed by terminating the program.

Although in the present embodiment, the performance of a musical piece is started upon operating the start switch of the switch group 4, this is not limitative, but the performance may be started at a time point the tempo control signal-generating device 1 starts to be swung, at a time point a performance start switch, not shown, of the electronic musical instrument 21 is operated, or at any other suitable time point.

Figure 19:
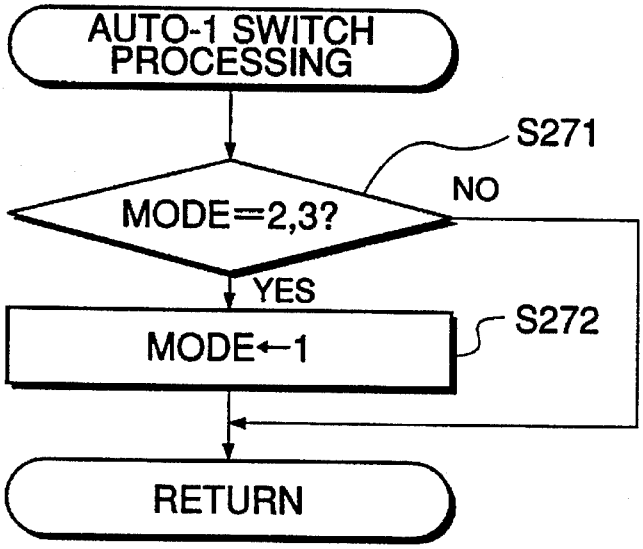
FIG. 19 is a flowchart showing an auto-1 switch processing routine executed by the CPU of the electronic musical instrument when an auto-1 switch of the switch group of the tempo control signal-generating device is operated.

FIG. 19 shows an auto-1 switch processing routine executed when the auto-1 switch of the switch group 4 is operated, which is one of the subroutines of the MIDI processing executed at the step S53 of the FIG. 11 main routine.

First, at a step S271, it is determined whether or not a tempo control mode MODE has been set to "2" or "3". The tempo control mode MODE here means the contents of a predetermined area MODE of the RAM 28. The predetermined area MODE stores any of the integers "1" to "3", with "1" corresponding to the auto-1 mode, "2" corresponding to the auto-2 mode, and "3" corresponding to the manual mode.

If it is determined at the step S271 that the tempo control mode MODE has been set to "2" or "3", the tempo control mode MODE is set to "1" at a step S272, whereas if it is determined that the tempo control mode MODE has been set to "1", the auto-1 switch subroutine is immediately terminated.

Figure 20:
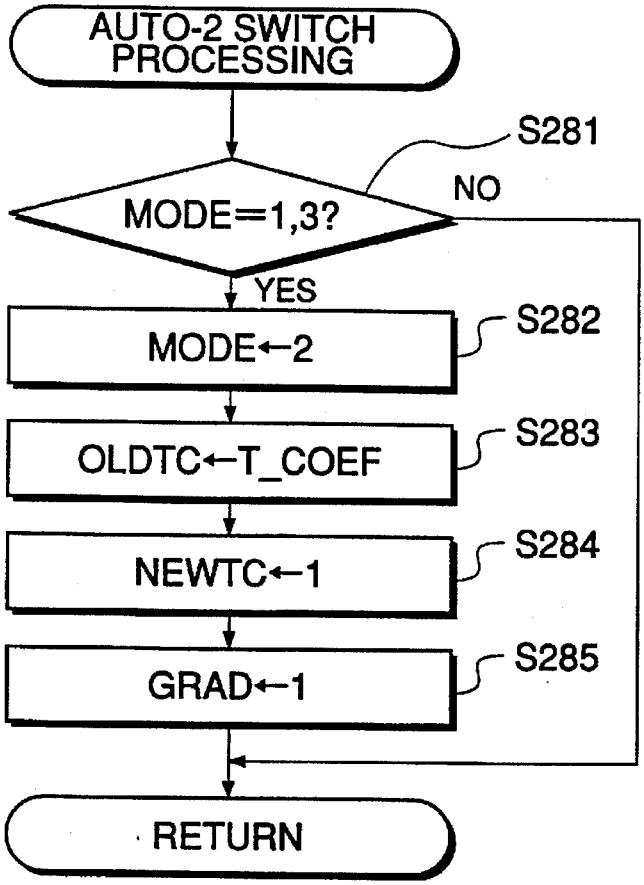
FIG. 20 is a flowchart showing an auto-2 switch processing routine executed by the CPU of the electronic musical instrument when an auto-2 switch of the switch group of the tempo control signal-generating device is operated.

FIG. 20 shows an auto-2 switch processing routine executed when the auto-2 switch of the switch group 4 is operated, which is also one of the subroutines of the MIDI processing executed at the step S53 of the FIG. 11 main routine.

First, at a step S281, it is determined whether or not the tempo control mode MODE has been set to "1" or "3". If it is determined at the step S281 that the tempo control mode MODE has been set to "2", the auto-2 switch subroutine is immediately terminated, whereas if it is determined that the tempo control mode MODE has been set to "1" or "3", the tempo control mode MODE is set to "2" at a step S282.

Then, the tempo coefficient T_COEF is stored in a predetermined area OLDTC for storing a used or old tempo coefficient at a step S283, and a coefficient value "1" for setting the standard tempo is stored in a predetermined area NEWTC of the RAM 28 for storing a new tempo coefficient (hereinafter, the contents of this area will be referred to as "the desired tempo coefficient NEWTC) at a step S284. Then, a flag GRAD, is set to "1" at a step S285, followed by terminating the present auto-2 switch. This flag GRAD is for causing the tempo to be progressively or gradually changed to the desired tempo (that is, for progressively changing the tempo coefficient to the desired tempo coefficient NEWTC).

Figure 21:
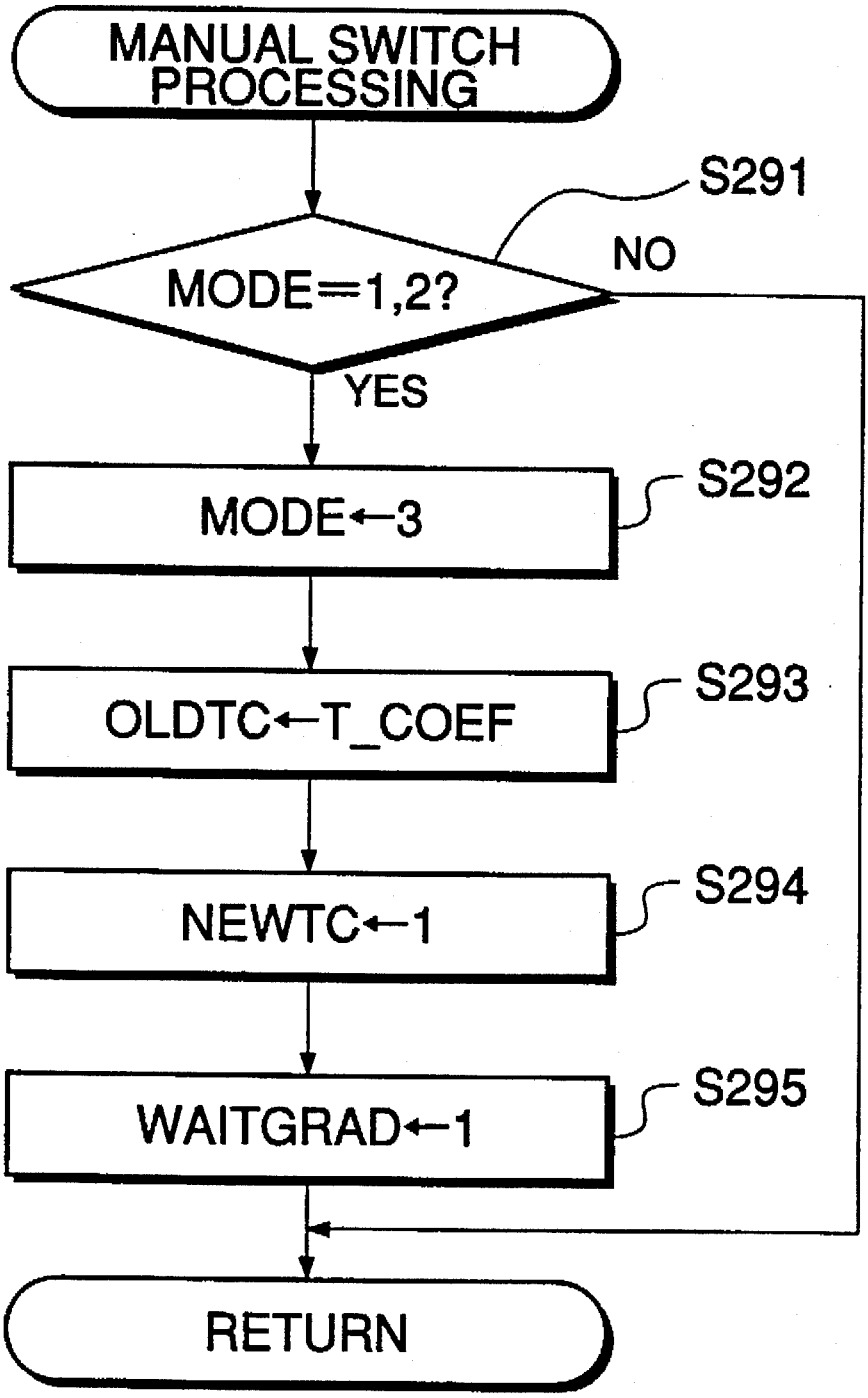
FIG. 21 is a flowchart showing a manual switch processing routine executed by the CPU of the electronic musical instrument when a manual switch of the switch group of the tempo control signal-generating device is operated.

FIG. 21 shows a manual switch processing routine executed when the manual switch of the switch group 4 is operated, which is also one of the subroutines of the MIDI processing executed at the step S53 of the FIG. 11 main routine.

First, at a step S291, it is determined whether or not the tempo control mode MODE has been set to "1" or "2". If it is determined at the step S291 that the tempo control mode MODE has been set to "3", the manual switch subroutine is immediately terminated, whereas if it is determined that the tempo control mode MODE has been set to "1" or "2", the tempo control mode MODE is set to "3" at a step S292.

Then, steps S293 and S294 are executed which are identical with those of the steps S283 and S284, respectively, and description thereof is omitted.

At the next step S295, a flag WAITGRAD for delaying execution of progressive change of the tempo to the desired tempo is set to "1", followed by terminating the program.

The flag WAITGRAD is employed to delay starting the processing of progressing changing the tempo to the desired tempo because the desired tempo cannot be set immediately after the tempo control mode is changed from the auto mode to the manual mode until after the tempo control operation is carried out by the player, which makes it necessary to cause starting of the above processing to be waited.

In this embodiment as well, the automatic performance data is reproduced according to the FIG. 13 routine described before.

Figure 22:
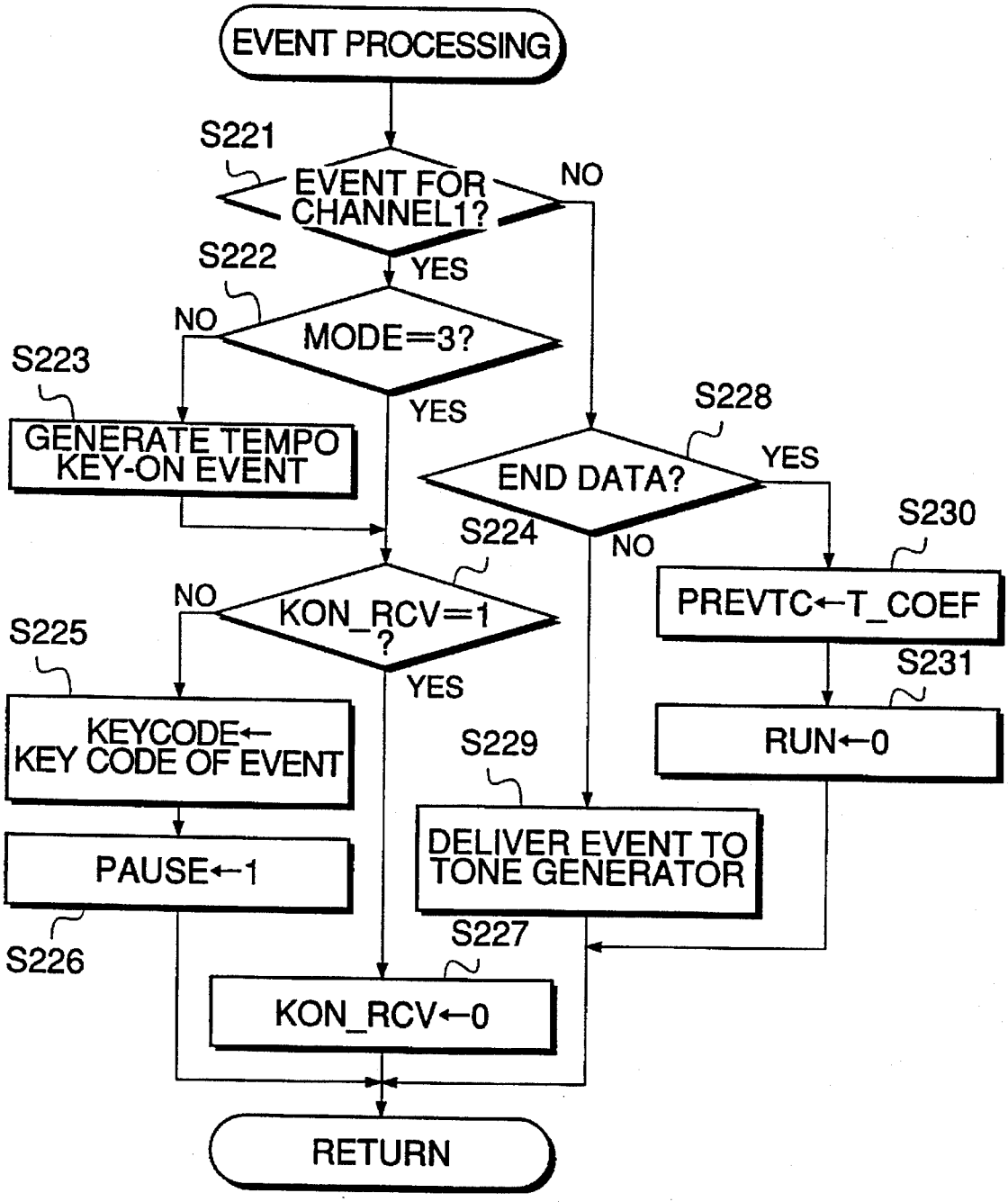
FIG. 22 is a flowchart showing an event processing subroutine executed at the step S106 of the FIG. 13 subroutine according to the second embodiment.

FIG. 22 shows an event-processing subroutine which is executed at the step S106 of the FIG. 13 routine according to the present embodiment.

First, it is determined at a step S221 whether or not the event data read out is event data for the channel 1. If the read data is event data for the channel 1, it is determined at a step S222 whether not the tempo control mode MODE is "3", i.e. the manual mode.

If it is determined at the step S222 that the tempo control mode is the auto mode (auto-1 or auto-2 mode, i.e. the tempo control mode MODE ≠3), a tempo key-on event is caused to be generated within the electronic musical instrument 21, and reception of the tempo key-on event data from the tempo control signal-generating device 1 is inhibited at a step S223. The generation of the tempo key-on event specifically means, in the present embodiment, storing key-on event data for the channel 1 read out at the step S104 of the FIG. 13 routine in a predetermined area AKON allocated to the RAM 28.

If it is determined at the step S222 that the manual mode has been selected (tempo control mode MODE=3), the program skips the step S223 over to a step S224.

At the step S224, it is determined, whether or not a flag KON_RCV which, when set to "1", indicates that corresponding tempo key-on event data has been received from the tempo control signal-generating device 1 before key-on event data for the channel 1 is read out, assumes "1". If the flag KON_RCV assumes "0", i.e. if the corresponding tempo key-on event data has not been received from the tempo control signal-generating device 1, the key code of the key-on event data is stored in an area KEYCODE allocated to the RAM 28 at a step S225, and the flag PAUSE is set at a step S225, followed by terminating the program.

On the other hand, if the flag KON_RCV assumes "1", the flag KON_RCV is reset at a step S227, followed by terminating the program.

On the other hand, if it is determined at a step S221 that the event data read out is not for the channel 1, it is determined at a step S228 whether or not the event data is end data.

If it is determined at the step S228 that the event data read out is not end data, which means that the event data is ordinary automatic performance event data, the program proceeds to a step 229, wherein the event data is delivered to the tone generator 33, whereas if the event data read out is end data, the tempo coefficient T_COEF being currently set is stored in the area PREVTC at a step S230, and the flag RUN is reset at a step S231, followed by terminating the program.

The tempo coefficient T_COEF stored in the area PREVTC at the step S230 is read therefrom to be used as the initial tempo coefficient when performance of a musical piece is started in the start mode 1, as described hereinbefore with reference to the step S262 of the FIG. 18 routine. This makes it possible to start performance of a musical piece at the tempo to which the tempo of performance was controlled in the last performance, and hence to start playing the musical piece at a stable tempo from the opening thereof.

Although in the present embodiment, the tempo coefficient T_COEF used at termination of performance of a musical piece is stored for use in the next performance of a musical piece, this is not limitative, but an average value of the tempo employed throughout performance of a musical piece may be calculated and stored for use in the next performance of a musical piece, instead. Further, a value of the tempo at timing of a predetermined portion of the musical piece may be adopted, which is assumed e.g. at a time point a predetermined time period elapses or a predetermined number of bars are performed after the start of performance of a musical piece, which is presumed to be stable enough for giving performance of the musical piece. Still further, an average value of the standard tempo of a musical piece and the manually-controlled tempo of the musical piece may be stored to start performance of a musical piece at the averaged tempo. Moreover, values of tempo used in several times of performance of musical pieces may be stored, and an average value of the stored tempo values may be used or one of the stored tempo values may be selected for use.

Besides, to set the initial tempo of a musical piece which is newly loaded into the electronic musical instrument for performance, a tempo coefficient stored in the area PREVTC of the RAM 28 for the same musical piece on which the tempo control has been effected, at the time of storing the musical piece in a memory device, may be written into a header area of the musical piece as musical piece data, whereby performance of the musical piece is started at the tempo set by the tempo coefficient.

When a new musical piece is selected and loaded into the electronic musical instrument for performance, a value of the tempo coefficient T_COEF so far set may be reset, and a value of the tempo coefficient T_COEF stored in the above header area may be used as a standard tempo of the musical piece. This makes it possible to start performance of the musical piece at the standard tempo every time the musical piece is played, even if the musical piece is once played at a tempo extremely different from the standard tempo.

A mode for starting performance of a musical piece at a controlled tempo and a mode for starting performance of the musical piece at a standard tempo may be provided so that the player can select one of the modes.

Figure 23:
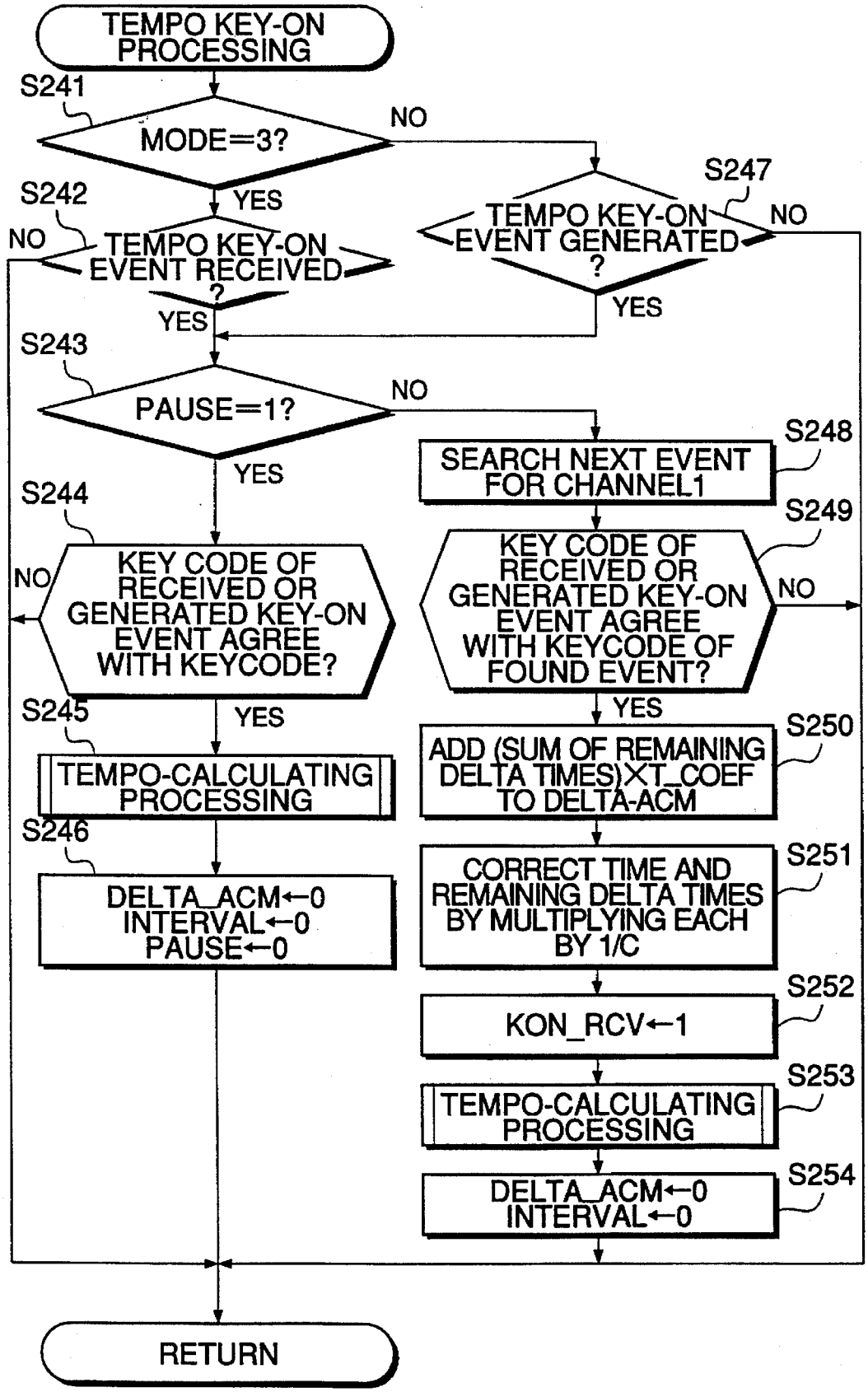
FIG. 23 is a flowchart showing a tempo key-on data-receiving subroutine executed at the step S113 of the FIG. 13 subroutine according to the second embodiment.

FIG. 23 shows a tempo key-on data-receiving subroutine executed at the step S113 of the FIG. 13 routine.

Figure 24:
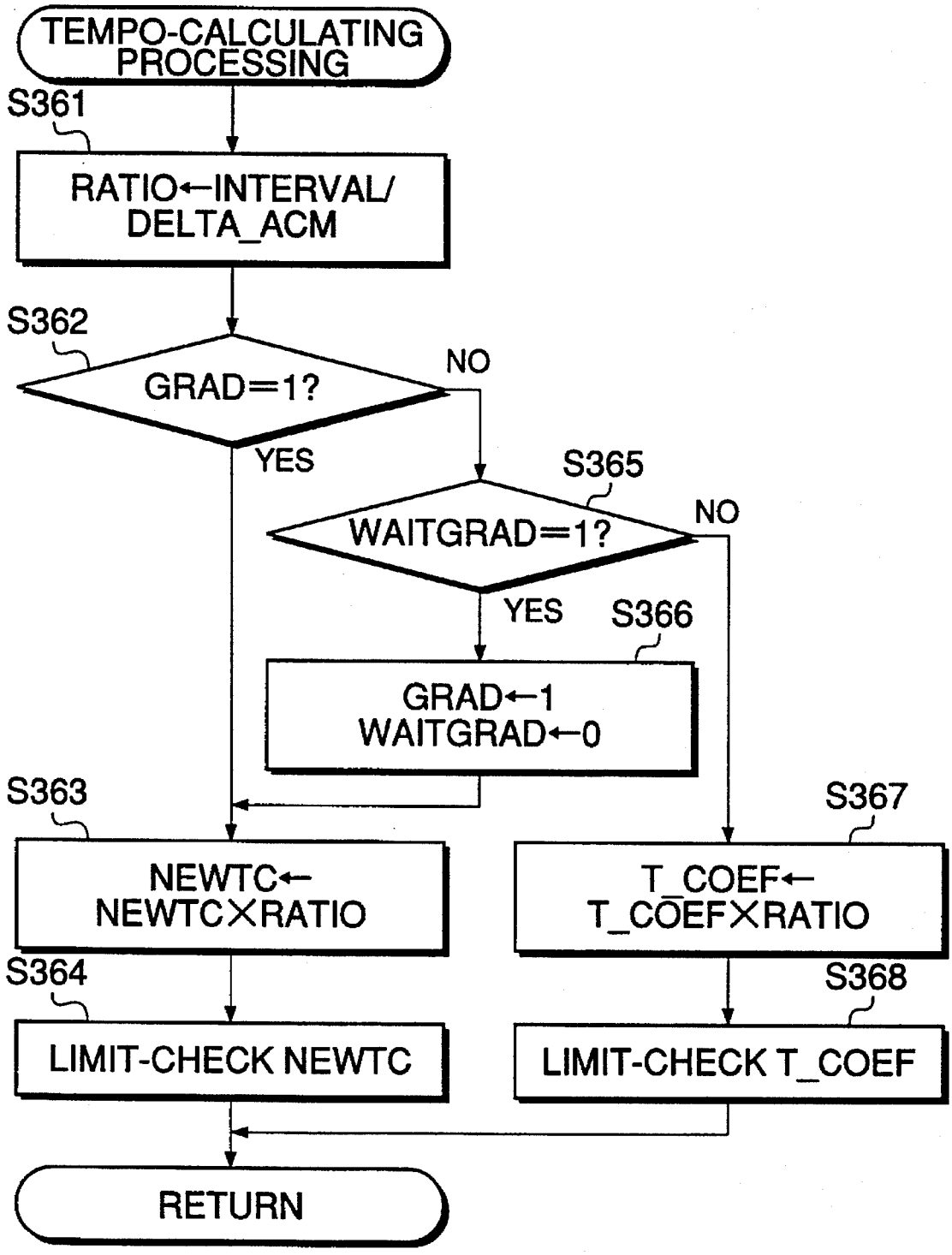
FIG. 24 is a flowchart showing a tempo-calculating subroutine executed at steps S145 and S150 of the FIG. 23 subroutine.

First, it is determined at a step S241 whether or not the tempo control mode is the manual mode (MODE=3). If the tempo control mode is the manual mode, it is determined at a step S242 whether or not tempo key-on event data has been received from the tempo control signal-generating device 1. If tempo key-on event data has been received, it is determined at a step S243 whether or not the flag PAUSE assumes "1". If the flag PAUSE assumes "1" at the step S243, it is determined at a step S244 whether or not the key code of the tempo key-on event data received from the device 1 or tempo key-on event data just generated within the electronic musical instrument 21 agrees with the aforementioned key code KEYCODE. If the former agrees with the latter, the program proceeds to a step S245, wherein a tempo-calculating subroutine shown in FIG. 24 is executed. Then, the delta time cumulative value DELTA_ACM, the tempo control interval INTERVAL, and the flag PAUSE are reset at a step S246, followed by terminating the present program. The reason for determining the agreement of the key code KECODE with the key code of the tempo key-on event data just generated within the electronic musical instrument 21 as well as that of the tempo key-on event data received from the tempo control signal-generating device 1 is that the present tempo key-on data-receiving subroutine is executed not only in the manual mode but also in the auto mode.

On the other hand, if it is determined at the step S242 that no tempo key-on event data has been received, or if it is determined at the step S244 that the key code of the tempo key-on event data received or just generated does not agree with the key code KEYCODE, the present program is immediately terminated.

If it is determined at the step S241 that the tempo control mode is not the manual mode, it is determined at a step S247 whether or not tempo key-on event data has been generated within the electronic musical instrument 21. If tempo key-on event data has been generated, the program proceeds to the step S243, whereas if no tempo key-on event data has been generated, the present subroutine is terminated.

The determination at the step S242 as to whether tempo key-on event data has been received and that at the step S247 as to whether tempo key-on event data has been generated can be carried out by checking the contents of the areas TKON and AKON, respectively.

On the other hand, if the flag PAUSE assumes "0" at the step S243, the program proceeds to steps S248 et seq. The steps S248 to S254 are identical to the steps S150 to S159 of the FIG. 16 subroutine of the first embodiment, except that "CHANNEL 1 OR 2" at the step S150 is changed to "CHANNEL 1" at the steps S148, the steps S155 to S157 of FIG. 16 are combined into a single step S253 for the tempo-calculating subroutine, and the steps S158 to S159 are grouped into a single step S254, and hence description thereof is omitted. In the present embodiment, however, "channel 1 or 2" in the description of corresponding parts of the first embodiment should read "channel 1" since in the present embodiment key-on event data for the channel 2 is not used for the tempo control.

FIG. 24 shows the tempo-calculating subroutine executed at the steps S245 and S250 of the FIG. 23 subroutine.

First, a ratio RATIO for changing the tempo coefficient T_COEF is calculated at a step S361, based on the delta time cumulative value DELTA_ACM and the tempo control interval INTERVAL, by the use of the equation:

$$\text{RATIO}=\text{INTERVAL}/\text{DELTA_ACM} \quad (3)$$

Results of the calculation are stored in a predetermined area RATIO allocated to the RAM 28.

Then, it is determined at a step S362 whether or not the flag GRAD is equal to "1". If the flag GRAD is equal to "1", i.e. if the tempo is to be progressively changed to the desired tempo, the desired tempo coefficient NEWTC is changed at a step S363 by the use of the following equation (9):

$$\text{NEWTC}=\text{NEWTC}\times\text{RATIO} \quad (9)$$

The reason for thus changing the desired tempo coefficient NEWTC is that in the manual mode, the desired tempo coefficient is also changed at the ratio RATIO in response to the tempo control operation by the player.

Then, limit-checking of the resulting desired tempo coefficient NEWTC value is executed at a step S364 to prevent the same from being largely changed, followed by terminating the program.

On the other hand, if it is determined at the step S362 that the flag GRAD assumes "0", it is determined at a step S365 whether or not the flag WATGRAD assumes "1". If the flag WAITGRAD assumes "1", i.e. if the present loop is executed immediately after the tempo control mode has been changed from the auto mode to the manual mode, the flag GRAD is set (to "1"), and the flag WAITGRAD is reset (to "0") at a step S366, followed by the program proceeding to the step S363.

On the other hand, if it is determined at the step S365 that the flag WAITGRAD assumes "0", the tempo coefficient T_COEF is changed by the use of the following equation (4):

$$\text{T_COEF}=T_\text{COEF}\times\text{RATIO} \quad (4)$$

Limit-checking of the changed T_COEF value is executed at a step S368 to prevent the tempo coefficient T_COEF from being largely changed.

Figure 25:
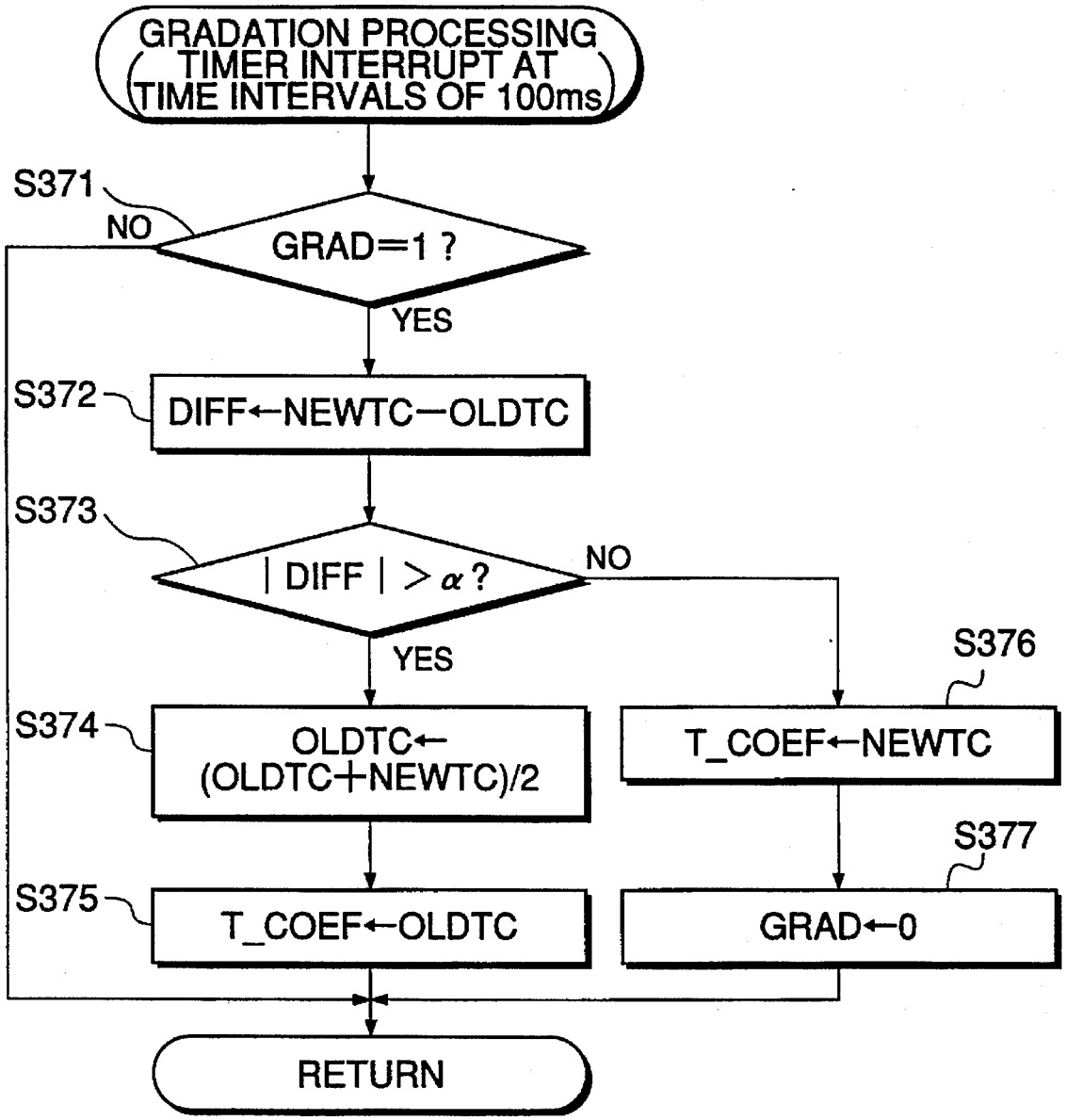
FIG. 25 is a flowchart showing a gradation-processing routine executed when a tempo control mode is changed, for progressively changing the tempo to a desired tempo.

FIG. 25 shows a gradation-processing routine for progressively changing the tempo to the desired tempo when the tempo control mode has been changed. This routine is executed e.g. as one of interrupt handling routines executed in synchronism with generation of a timer interrupt signal at time intervals of 100 milliseconds.

Referring to FIG. 25, it is determined at a step S371 whether or not the flag GRAD assumes "1". If the flag GRAD assumes "0", the present program is immediately terminated, whereas if the flag GRAD assumes "1", the program proceeds to a step S372.

At the step S372, a difference between the desired tempo coefficient NEWTC and the tempo coefficient T_COEF stored in the predetermined area OLDTC of the RAM 28 is calculated by the use of the following equation (10):

$$\text{DIFF}=\text{NEWTC}-\text{OLDTC} \quad (10)$$

The calculated difference is stored in an area DIFF allocated to the RAM 28 (hereinafter, the contents of this area will be referred to as "the difference DIFF").

Then, it is determined at a step S373 whether or not the absolute value |DIFF| of the difference DIFF is larger than a predetermined value $\alpha$. If $|\text{DIFF}|>\alpha$ holds, the tempo coefficient OLDTC is calculated at a step S374 by the use of the following equation (11):

$$\text{OLDTC}=(\text{OLDTC}+\text{NEWTC})/2 \quad (11)$$

The calculated tempo coefficient OLDTC is stored as the tempo coefficient T_COEF at a step S375, followed by terminating the program.

On the other hand, if it is determined at the step S373 that the absolute value |DIFF| is equal to or smaller than the predetermined value $\alpha$, the desired tempo coefficient NEWTC is stored as the tempo coefficient T_COEF at a step S376 without change, and the flag GRAD is reset at a step S377, followed by terminating the program.

Figure 26:
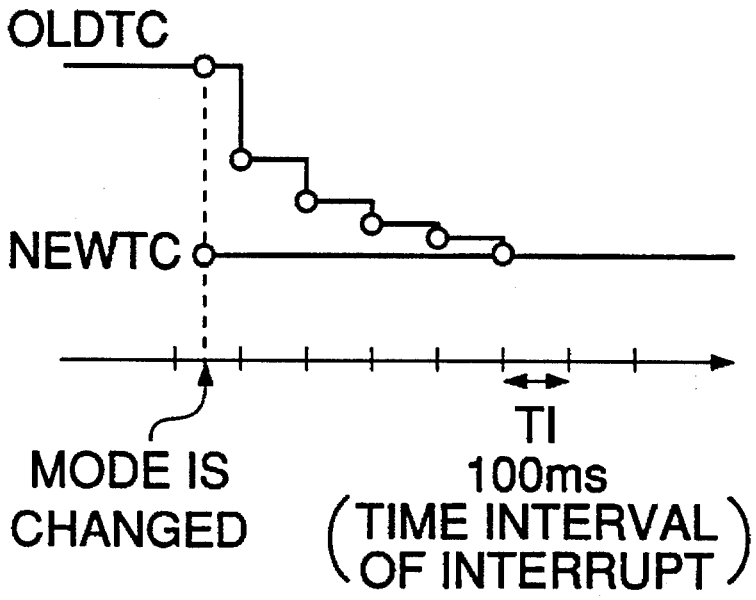
FIG. 26 is a diagram showing how a present value of a tempo coefficient is progressively changed to a desired value by the gradation-processing routine.

FIG. 26 shows the manner of progressively changing the tempo coefficient to the desired tempo coefficient. In the figure, the abscissa represents time, and TI designates a timer interrupt interval (100 milliseconds in the present embodiment). As can be understood from the figure, when the tempo control mode is changed, the tempo coefficient OLDTC is changed toward the desired tempo coefficient NEWTC by an amount equal to half of the difference between the tempo coefficient OLDTC and the desired tempo coefficient NEWTC whenever the timer interrupt occurs.

Thus, if when the tempo control mode is change, a large change occurs in the tempo between a value before the change and a value after the change, the gradation-processing routine is executed to progressively change the former to the latter, which makes it possible to change the tempo such that the performance is given in a natural manner.

The method of gradation is not limited to the above described example. Alternatively, the tempo may be progressively made closer to the desired tempo coefficient NEWTC by a predetermined constant amount α.

Figure 27:
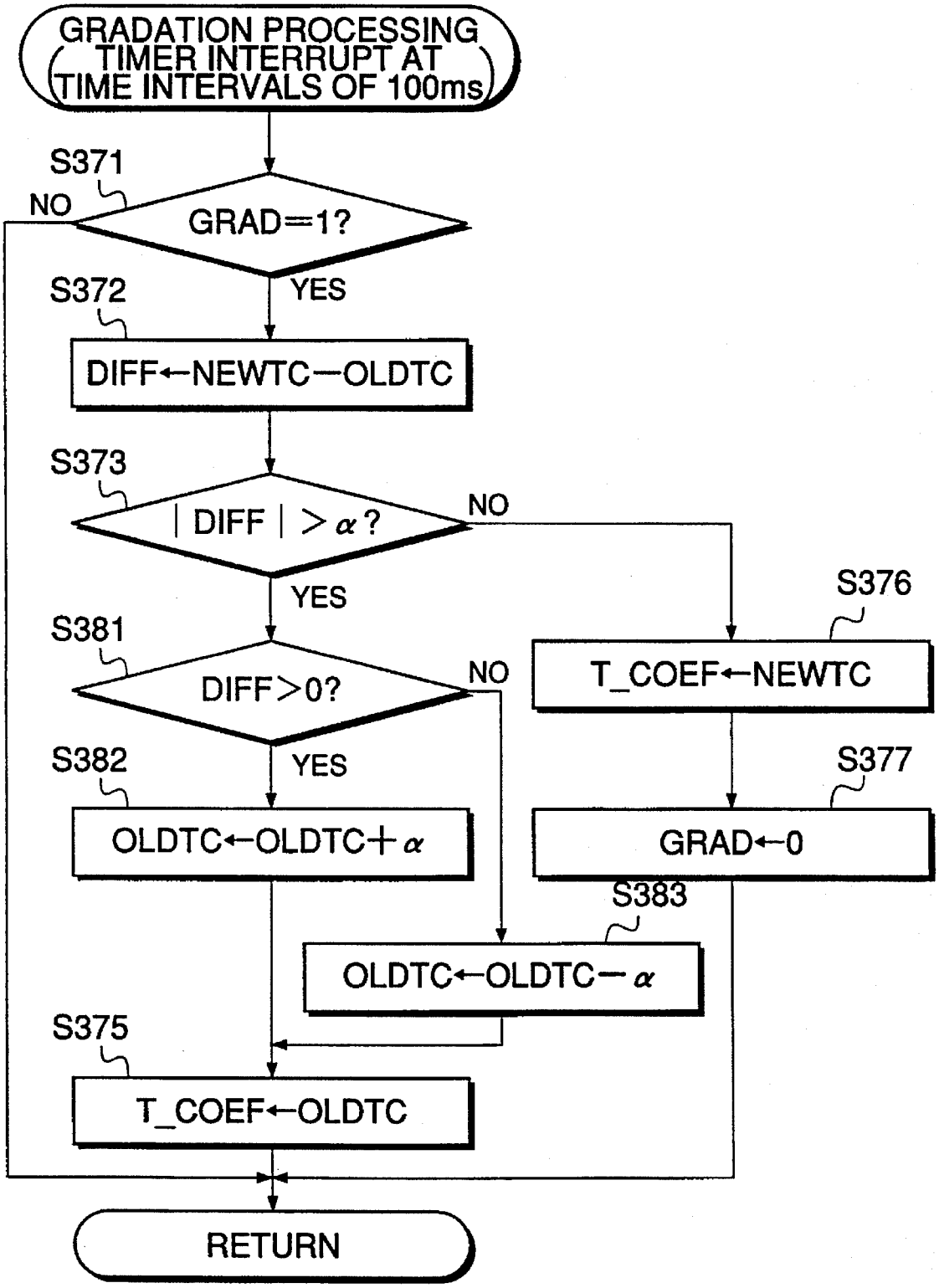
FIG. 27 is a flowchart of a variation of the FIG. 25 gradation-processing routine.

FIG. 27 shows a variation of the gradation-processing routine for progressively changing the tempo according to the alternative method. In the figure, steps corresponding to steps of the FIG. 25 subroutine are designated by identical step numbers, and description thereof is omitted.

If it is determined at the step S373 that the absolute value |DIFF| is larger than the predetermined value α, it is determined at a step S381 whether or not the difference DIFF is larger than "0". If DIFF>"0" holds, i.e. if the tempo coefficient OLDTC is smaller than the desired tempo coefficient NEWTC, the tempo coefficient OLDTC is increased by the predetermined amount α at a step S382 to thereby progressively make the tempo coefficient closer to the desired tempo coefficient NEWTC. On the other hand, if DIFF≦0 holds, i.e. if OLDTC≧NEWTC holds, the tempo coefficient OLDTC is decreased by the predetermined amount α at a step S383 to thereby progressively make the tempo coefficient closer to the desired tempo coefficient NEWTC.

Figure 28:
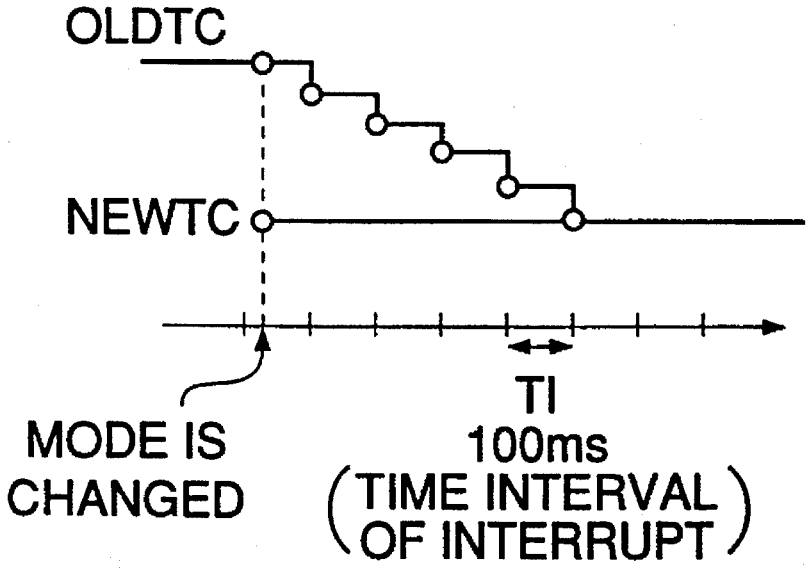
FIG. 28 is a diagram showing how the present value of the tempo coefficient is progressively changed to a desired value by the FIG. 27 gradation processing routine.

FIG. 28 shows the manner of progressively changing the tempo coefficient to the desired tempo coefficient by the FIG. 27 gradation-processing routine. As is learned from the figure, when the tempo control mode is changed, the tempo coefficient OLDTC is progressively changed to the desired tempo coefficient NEWTC by the predetermined constant amount α whenever the timer interrupt occurs.

As described above, according to the present embodiment, a start mode is provided for selectively starting the automatic performance of a musical piece by the use of a tempo coefficient applied on the last occasion when the start mode is "1", which makes it possible to start the performance of a musical piece from the opening thereof at the tempo desired by the player.

Further, according to the present embodiment, three kinds of tempo control modes are provided, and once the tempo control mode has been shifted to a selected mode, the selected mode is held on to thereby make it possible to hold the tempo of performance as desired by the player even if he operates the tempo control apparatus unintentionally or carelessly. More specifically, once the auto-1 switch or the auto-2 switch has been operated to shift the tempo control mode to the auto mode, the manual tempo control is no longer active, so that even if the tempo control signal-generating device 1 is moved inadvertently, the tempo is not disordered. This is useful particularly when a player or a singer intends to control the tempo only at the opening of a musical piece or between song parts of a song and sing the song in a concentrated manner at the remaining portions of the musical piece. If he operates the manual switch after he finishes singing, the manual tempo control can be effected.

Still further, since the tempo is progressively changed to the desired tempo according to the gradation-processing routine, it is possible to change the tempo such that the performance is given in a natural manner without causing any odd impression of performance.

Although in the present embodiment, once the tempo control mode has been changed to the auto mode, the tempo is not changed thereafter so long as the auto mode is continued, this is not limitative. Alternatively, tempo control data may be stored in a predetermined area of the RAM 28, and based on the tempo control data, the tempo may be automatically changed. According to this alternative method, so long as the tempo control data stored are indicative of change ratios of the tempo, the tempo can be changed without any inconvenience in the auto-1 mode. There is of course no problem even if the alternative method is also applied in the auto-2 mode.

Although in the first and second embodiments described above, the tempo is controlled by multiplying the value of delta time by the tempo coefficient T_COEF to thereby increase or decrease the value of each delta time, this is not limitative, but the repetition period of tempo control operation, i.e. timing of interrupt of tempo control processing by the CPU may be changed to thereby change the tempo. Further, the value of each delta time may be changed by adding or subtracting a predetermined value to or from the delta time, instead of multiplying the delta time by the tempo coefficient.

Although in the above described embodiments, swing motions of the tempo control signal-generating device 1 are detected based on output signals from the two gyroscopic piezoelectric angular velocity sensors 2, 3, this is not limitative, but three or more gyroscopic piezoelectric angular velocity sensors may be employed to detect swing motions of the device 1. Further, any other kind of sensor such as an acceleration sensor or a sensor utilizing magnetism or light may be used so long as it can detect swing motions of the device 1. Further, a combination of these sensors may be employed. Besides, the swing motion-detecting means is not limited to sensors, but a camera or image pick-up device may be employed to pick up images of swing motions of the device 1 and detect the swing motions through image processing, for example.

Still further, although in the above described embodiments, the number of kinds of swing motions of the tempo control signal-generating device 1 is limited to three, this is not limitative, but a larger number of swing motions may be detected. To this end, a larger number of gyroscopic piezoelectric angular velocity sensors may be employed, for example, to detect a larger number of kinds of swing motions with accuracy. In addition, to detect the three kinds of swing motions of the device 1 according to the above described embodiments, different sensors may be employed in a selective manner to detect swing motions for a triple measure and ones for a simple duple or quadruple measure, respectively. Alternatively, outputs from three or more sensors may be used at one time to synthetically detect swinging motions.

Although in the above described embodiments, the piezoelectric sensors are incorporated within the tempo control signal-generating device 1, which can be held in one hand, this is not limitative, but sensors for detecting swing motions of the player for tempo control may be fit on the player (on his hand or arm, for example), or may be contained in a microphone. Further, they may be mounted within a remote control device of a so-called karaoke machine or a like machine.

Although in the above described embodiments, the tempo control signal is generated by swing motions of the tempo control signal-generating device 1, this is not limitative, but the tempo control signal may be generated by tapping motions of the player or by operation of a performance operating element.

Further, although in the above described embodiments, the tempo control signal-generating device 1 for detecting the kinds of swing motions of the player and a distinguishing point (peak or base) thereof and generating a signal for tempo control and the electronic musical instrument having the function of automatic performance which is controlled in respect of tempo of performance of a musical piece reproduced thereby are formed in separate pieces, this is not limitative, but they may be constructed in one piece. Further, a tempo clock or signal may be supplied to an external device outside the tempo control apparatus to control the tempo of performance given by the external device.

During manual control of the tempo, interpolation may be carried out between an actual tempo value before a tempo-changing operation and a desired tempo value to which the tempo is to be changed to thereby effect smooth change of the tempo.

The object to be controlled in tempo by the tempo control apparatus according to the invention is not limited to automatic performance, but it may be automatic accompaniment, automatic rhythm, or the like. Further, reproduction of images, such as dynamic images, may also be controlled according to the tempo of performance of a musical piece, which is controlled as described hereinabove.

What is claimed is:

1. A tempo control apparatus comprising:

tempo control signal-generating means for generating a tempo control signal in response to operation of an operator;

automatic performance data-storing means for storing automatic performance data;

tempo control data-storing means for storing a plurality of kinds of tempo control data for controlling tempo of automatic performance of a musical piece as said automatic performance of said musical piece proceeds, when said automatic performance data is reproduced;

selecting means for selecting one of said plurality of kinds of tempo control data stored in said tempo control data-storing means; and tempo control means for controlling said tempo of said automatic performance of said musical piece based on the selected one of said plurality of kinds of tempo control data and said tempo control signal generated by said tempo control signal-generating means.

2. A tempo control apparatus according to claim 1, wherein said plurality of kinds of tempo control data correspond to respective timings of said operation of said tempo control signal-generating means by said operator.

3. A tempo control apparatus according to claim 2, wherein said plurality of kinds of tempo control data comprise tempo control data corresponding to timing of each beat of said musical piece, and tempo control data corresponding to timing of each note of said musical piece.

4. A tempo control apparatus according to claim 1, wherein said tempo control signal-generating means is movable by said operation of said operator, to detect a peak of angular velocity of a motion of said operator in a predetermined direction to thereby generate said tempo control signal.

5. A tempo control apparatus comprising:

tempo control signal-generating means for generating a tempo control signal in response to operation of an operator;

data-storing means for storing automatic performance data and a plurality of kinds of tempo control data for controlling tempo of automatic performance of a musical piece as said automatic performance of said musical piece proceeds, when said automatic performance data is reproduced;

selecting means for selecting one of said plurality of kinds of tempo control data stored in said data-storing means;

detecting means for detecting the selected one of said plurality of kinds of tempo control data from said plurality of kinds of tempo control data stored in said data-storing means as said automatic performance of said musical piece proceeds; and tempo control means for controlling said tempo of said automatic performance of said musical piece based on the detected selected one of said plurality of kinds of tempo control data and said tempo control signal generated by said tempo control signal-generating means.

6. A tempo control apparatus according to claim 5, wherein said plurality of kinds of tempo control data correspond to respective timings of said operation of said tempo control signal-generating means by said operator.

7. A tempo control apparatus according to claim 5, wherein said plurality of kinds of tempo control data comprise tempo control data corresponding to timing of each beat of said musical piece, and tempo control data corresponding to timing of each note of said musical piece.

8. A tempo control apparatus according to claim 5, wherein said automatic performance data includes event data having the same data format as said plurality of kinds of tempo control data, said plurality of kinds of tempo control data being given at least one predetermined channel number for discriminating said plurality of kinds of tempo control data from said event data.

9. A tempo control apparatus according to claim 5, wherein said tempo control signal-generating means is movable by said operation of said operator, to detect a peak of angular velocity of a motion of said operator in a predetermined direction to thereby generate said tempo control signal.

10. A tempo control apparatus comprising:

tempo control signal-generating means for generating a tempo control signal in response to operation of an operator;

tempo control means for controlling tempo of automatic performance based on said tempo control signal generated by said tempo control signal-generating means;

tempo-storing means for storing said tempo of automatic performance controlled by said tempo control means; and initial tempo-determining means for determining an initial tempo at which said automatic performance is to be started, based on said tempo stored in said tempo-storing means;

wherein said tempo control means starts controlling said tempo of automatic performance to the determined initial tempo.

11. A tempo control apparatus comprising:

tempo control signal-generating means for generating a tempo control signal in response to operation of an operator;

tempo mode changeover means for changing over a mode of control of tempo of automatic performance between a manual tempo control mode in which said tempo of said automatic performance is controlled based on said tempo control signal and an automatic tempo control mode in which said tempo of said automatic performance is automatically controlled irrespective of said tempo control signal; and tempo control means for controlling said tempo of said automatic performance in said mode of control of said tempo of automatic performance selected by said changeover by said tempo mode changeover means;

wherein when said mode of control of said tempo of automatic performance is changed over by said tempo mode changeover means, said tempo control means controls said tempo of automatic performance by progressively changing said tempo of automatic performance from a tempo assumed before said changeover of said mode of control to a tempo to be assumed after said changeover of said mode of control.

12. A tempo control apparatus according to claim 11, wherein said automatic tempo control mode is a mode in which said tempo of said automatic performance is maintained at a tempo to which said tempo of said automatic performance has been controlled in said manual control mode before said changeover of said mode of control.

13. A tempo control apparatus according to claim 11, wherein said automatic tempo control mode is a mode in which said tempo of said automatic performance is set to a standard tempo for performance of a musical piece of which automatic performance is being given, irrespective of a tempo assumed before said changeover of said mode of control.

14. A tempo control apparatus according to claim 11, wherein said tempo control means progressively changes said tempo of said automatic performance by an amount commensurate with a difference between said tempo assumed before said changeover of said mode of control and said tempo to be assumed after said changeover.

15. A tempo control apparatus according to claim 11, wherein said tempo control means progressively changes said tempo of said automatic performance by a predetermined constant amount.

16. A tempo control apparatus comprising:

a tempo control signal-generating device which generates a tempo control signal in response to operation of an operator;

an automatic performance data-storing device which stores automatic performance data;

a tempo control data-storing device which stores a plurality of kinds of tempo control data for controlling tempo of automatic performance of a musical piece as said automatic performance of said musical piece proceeds, when said automatic performance data is reproduced;

a selecting device which selects one of said plurality of kinds of tempo control data stored in said tempo control data-storing device; and a tempo control device which controls said tempo of said automatic performance of said musical piece based on the selected one of said plurality of kinds of tempo control data and said tempo control signal generated by said tempo control signal-generating device.

17. A tempo control apparatus comprising:

a tempo control signal-generating device which generates a tempo control signal in response to operation of an operator;

a data-storing device which stores automatic performance data and a plurality of kinds of tempo control data for controlling tempo of automatic performance of a musical piece as said automatic performance of said musical piece proceeds, when said automatic performance data is reproduced, in a mixed manner;

a selecting device which selects one of said plurality of kinds of tempo control data stored in said data-storing device;

a detecting device which detects the selected one of said plurality of kinds of tempo control data from said plurality of kinds of tempo control data stored in said data-storing device as said automatic performance of said musical piece proceeds; and a tempo control device which controls said tempo of said automatic performance of said musical piece based on the detected selected one of said plurality of kinds of tempo control data and said tempo control signal generated by said tempo control signal-generating device.

18. A tempo control apparatus comprising:

a tempo control signal-generating device which generates a tempo control signal in response to operation of an operator;

a tempo control device which controls tempo of automatic performance based on said tempo control signal generated by said tempo control signal-generating device;

a tempo-storing device which stores said tempo of automatic performance controlled by said tempo control device; and an initial tempo-determining device which determines an initial tempo at which said automatic performance is to be started, based on said tempo stored in said tempo-storing device;

wherein said tempo control device starts controlling said tempo of automatic performance to the determined initial tempo.

19. A tempo control apparatus comprising:

a tempo control signal-generating device which generates a tempo control signal in response to operation of an operator;

a tempo mode changeover device which changes over a mode of control of tempo of automatic performance between a manual tempo control mode in which said tempo of said automatic performance is controlled based on said tempo control signal and an automatic tempo control mode in which said tempo of said automatic performance is automatically controlled irrespective of said tempo control signal; and a tempo control device which controls said tempo of said automatic performance in said mode of control of said tempo of automatic performance selected by said changeover by said tempo mode changeover device;

wherein when said mode of control of said tempo of automatic performance is changed over by said tempo mode changeover device, said tempo control device controls said tempo of automatic performance by progressively changing said tempo of automatic performance from a tempo assumed before said changeover of said mode of control to a tempo to be assumed after said changeover of said mode of control.

* * * * *